US006925927B2

(12) United States Patent
Peck

(10) Patent No.: US 6,925,927 B2
(45) Date of Patent: Aug. 9, 2005

(54) MANUALLY OPERATED PUMP OR COMPRESSOR

(76) Inventor: Julian Claude Peck, 46 Kingswood Avenue, Jesmond, Newcastle-upon-Tyne (GB), NE2 3NS ( * ) Notice: Subject to any disclaimer, the term of this patent is extended or adjusted under 35 U.S.C. 154(b) by 124 days.

(21) Appl. No.: 10/340,080

(22) Filed: Jan. 10, 2003

(65) Prior Publication Data

US 2004/0028540 A1 Feb. 12, 2004

Related U.S. Application Data

(63) Continuation of application No. 09/806,598, filed as application No. PCT/GB99/02982 on Sep. 9, 1999, now abandoned.

(30) Foreign Application Priority Data

Oct. 1, 1998 (GB) ..... 9821411
Oct. 1, 1998 (GB) ..... 9821414

(51) Int. Cl.[7] ..... F01B 9/00
(52) U.S. Cl. ..... 92/137; 74/89.2
(58) Field of Search ..... 92/137; 74/89.2; 123/185.3

(56) References Cited

U.S. PATENT DOCUMENTS 1,445,721 A 2/1923 Schleppy
1,921,265 A 8/1933 Shortt
2,730,092 A * 1/1956 Reif ..... 123/185.3
2,784,676 A 3/1957 Woodward
4,068,644 A 1/1978 Newport
5,180,283 A 1/1993 Vickery, III
5,397,144 A 3/1995 Mirand et al.
6,227,810 B1 5/2001 Huang et al.

FOREIGN PATENT DOCUMENTS

EP 0 444 387 A 9/1991
EP 0 806 568 A2 11/1997

* cited by examiner

*Primary Examiner*—F. Daniel Lopez
(74) *Attorney, Agent, or Firm*—Daly, Crowley, Mofford & Durkee, LLP

(57) ABSTRACT

Apparatus comprising a pump or compressor operated by a pull-cord wound around a pulley (9), in which the pulley drives a shaft (11) which drives the pump or compressor, and the pulley is recoiled by means of a retractor type spring (32), torsion bar or elastic band. The retractor spring is mounted not both co-planar and co-axial with the pulley. The principal may be applied to reciprocating or rotary pumps or compressors, with compressible or incompressible fluid.

20 Claims, 16 Drawing Sheets

Cam rotates anticlockwise to drive pistons

| Angle (degrees) | Radius (mm) | Angle (degrees) | Radius (mm) |
|---|---|---|---|
| | | | |
| 0 | 20.000 | | |
| 5 | 20.000 | 95 | 14.790 |
| 10 | 20.000 | 100 | 14.341 |
| 15 | 19.820 | 105 | 13.876 |
| 20 | 19.625 | 110 | 13.396 |
| 25 | 19.414 | 115 | 12.899 |
| 30 | 19.186 | 120 | 12.386 |
| 35 | 18.943 | 125 | 11.858 |
| 40 | 18.684 | 130 | 11.314 |
| 45 | 18.410 | 135 | 10.754 |
| 50 | 18.119 | 140 | 10.178 |
| 55 | 17.813 | 145 | 9.586 |
| 60 | 17.490 | 150 | 8.979 |
| 65 | 17.152 | 155 | 8.355 |
| 70 | 16.798 | 160 | 7.716 |
| 75 | 16.428 | 165 | 7.061 |
| 80 | 16.043 | 170 | 6.390 |
| 85 | 15.641 | 175 | 5.703 |
| 90 | 15.224 | 180 | 5.000 |

Round Shaft (Cross Section)

Hexagonal Shaft (Cross Section)

Octagonal Shaft (Cross Section)

Asymmetric Shaft (Cross Section)

Rotary Cleat System Type Shaft

Rotary Cleat System Type Shaft-Cross Section showing Splines

MANUALLY OPERATED PUMP OR COMPRESSOR

CROSS-REFERENCE TO RELATED APPLICATIONS

This application is a continuation of, and claims the benefit of U.S. application Ser. No. 09/806,598, filed on Mar. 29, 2001, now abandoned, which is the U.S. national stage of PCT/GB99/02982 filed on 09 Sep. 1999, which PCT application claims the benefit of GB9821411.7 filed on 01 Oct. 1998 and GB9821414.1 filed on 01 Oct. 1998, which applications are hereby incorporated herein by reference in their entirety.

This invention relates to a manually operated pump or compressor, suitable for use in inflating bicycle tyres and other applications involving the compression or movement of compressible fluids or the movement of incompressible fluids.

Many manually operated pumps suitable for the above applications are already known in prior art. In particular, many portable bicycle pumps are positive displacement reciprocating action pumps in which a single piston reciprocates inside a single cylinder and the user pushes directly on the piston. I shall term such devices 'conventional bicycle pumps'.

Among the numerous design objectives for a bicycle pump should be included:

Small size

Low weight

Economy of manufacture

High Pressure Capability

Speed of use (ability to inflate a tyre to desired pressure as quickly as possible)

Ease of use (ability to inflate a tyre to high pressure without requiring excessive manual strength)

Convenience of use (eg, the ability to inflate a tyre without bending down)

Another desirable objective would be to allow the pump to be easier to use for children than for adults.

Conventional bicycle pumps have a number of disadvantages. In particular, the selection of both bore and stroke for the piston necessitate design compromises. There is a certain amount of energy required to inflate a tyre, and for a conventional bicycle pump the user compresses air by pushing directly on the piston. The energy used to compress the air is force times distance. The force depends on the air pressure in the tyre, and on the bore of the cylinder. The distance is a function of the length of the pump.

The pump will be quick to use if it has a large bore and a long stroke, but the large bore may mean that the compressive force required on the piston will become excessive at high pressures and a long stroke will make the pump less portable.

Further disadvantages of conventional bicycle pumps are that they use only the arm and shoulder muscles, which are not the body's strongest muscles—and that the user must bend down to use the pump.

Another class of bicycle pumps which are known in prior art are what I shall term "rope driven pumps".

These seek to mitigate the disadvantages of conventional bicycle pumps by employing an alternative means of transmitting power from the user to the pump itself.

Rope driven pumps typically comprise a body, held down usually by the user's foot, and one or more ropes on which the user pulls to drive the pump. The present invention is a rope driven pump.

Rope driven pumps are, in principle, superior to conventional bicycle pumps in terms of the design objectives listed above for several reasons. Firstly, when pulling on a rope, the energy used to compress the air is again force times distance, but now the distance is the length of the rope, which can be in the range of one to two meters—without the size of the apparatus increasing by a corresponding amount. Secondly, the user can operate the apparatus standing up, which is more convenient. Thirdly, the user can use their legs, arms, shoulders and back muscles to pull on the rope as this is essentially a lifting operation. The human body is very efficient at lifting things, so this is a significant ergonomic advantage over conventional bicycle pumps.

Two main kinds of rope driven pumps are known. The first kind comprises two handles and is operated with two hands, driving the pump in both directions. An example is U.S. Pat. No. 5,180,283 (Vickery). Such pumps suffer several disadvantages. Firstly, it is important that the length of rope is correct for each user—and since some people are taller than others, the length of rope should be made adjustable. Secondly, after use the rope is left outside the body of the pump. It is usually best to coil the rope around a part of the apparatus, but this is somewhat inelegant. Thirdly, since the arrangement is substantially symmetrical, it is desirable for the user to place both feet on the apparatus to stabilise it against the tensile forces applied to it by the ropes—but this can make the user lose his/her balance and may require the body of the apparatus to be larger than would otherwise be necessary.

In the second kind of rope driven pump, the pump is driven only in one direction. The rope is pulled off a pulley and this process drives the pump, then as the handle is released a coiled spring recoils the rope onto the pulley and the pulley is disengaged from the pump by some sort of clutch or ratchet means. An example is EP 0806568 (Festo).

The present invention is an example of this second kind of rope driven pump.

It should be noted that the application of the present invention is not limited to bicycle pumps as it may also be used for other inflation or air movement applications, or with incompressible fluids such as water in a bilge-pump or similar application. In particular, the present invention may be used as a pump for compressing air for use in spraying systems, such as domestic or commercial garden spraying systems.

According to the present invention there is provided apparatus for movement or compression of a fluid, comprising:

pump or compressor means arranged to receive a mechanical rotational drive input by way of a rotary shaft; and drive means arranged to provide said drive input;

said drive means comprising:

a rotary part and pull-cord means passing around said rotary part such that said rotary part rotates when an end of said pull-cord means is pulled by a user, the rotation of said rotary part being used to provide said mechanical rotational drive input; and torque providing means arranged to provide a torque acting to retract said pull-cord means;

wherein said rotary means and said torque providing means are not both co-axial and co-planar.

In the context of the design objectives for bicycle pumps listed earlier, the present invention has a significant advantage over the prior art, and in particular over the arrangement proposed in EP 0806568. The problem with earlier rope driven pumps is that the arrangements proposed have caused the pumps to be too large, too heavy or too expensive to be commercially viable. EP 0806568 shows the main spring to be coiled inside the pulley, which is an obvious way to save space in the overall arrangement. However, the present invention actually saves space by the counter-intuitive step of separating the spring from the pulley, increasing the outer diameter of the spring drum and thereby reducing the inner diameter of the pulley.

The reason that this enables the overall size of the apparatus to be reduced is that the separation of the spring from the pulley allows the free and independent design of these two critical components. The use of a larger diameter spring enables the spring to provide a larger number of turns. However, in EP 0806568, this would provide no benefit as it would increase the diameter of the pulley—which would reduce the number of turns of the cord, for a given length of pull. According to the present invention, the diameter of the spring can be increased, to increase the number of turns available, and the diameter of the pulley can be reduced, so that for a given length of pull the pulley will turn through a larger number of revolutions.

In order to inflate a bicycle tyre, a certain volume of free air needs to be compressed, according to the size of the tyre and the pressure required. It would be advantageous to achieve this with as few pulls of the cord as possible. The present invention allows a larger volume of free air to be compressed for each pull of the cord—or it allows the size of the cylinders to be reduced without diminishing the amount of air transferred by each pull of the cord. Since the cylinders are some of the largest components in the apparatus, this enables the overall size of the apparatus to be reduced.

The apparatus proposed in EP 0806568 does not allow a large volume of free air to be compressed for each pull of the cord, unless the cylinder used is large. If a large cylinder is used, the apparatus becomes larger, and it will become difficult to pull the cord at high pressures.

The present invention allows the cord to be wrapped initially around a small pulley diameter, so that when most of the cord has been uncoiled off the pulley, a large volume of air is compressed for a given length of pull on the cord. However, as the cord recoils onto the pulley, the effective diameter of the pulley increases. The effect of this is that with the larger effective diameter, less air is compressed for a given length of pull on the cord.

This will be the case when most of the cord is coiled around the pulley, which will happen when the handle is close to the apparatus. Therefore the cord will be easy to pull and the pump will run slowly when the handle is close to the apparatus. This is advantageous because it makes it easier to start the pump (overcoming any stiction, and building up some initial momentum) and because it makes the pump easier to use for smaller people, especially children.

Once the pulley and main shaft are rotating, the system has some momentum and initial stiction has been overcome. It is therefore advantageous that the effective diameter of the pulley reduces as the cord unwinds from it, causing more air to be compressed for a given length of pull on the cord.

A further advantage of this effect arises because people vary in size: and smaller people, especially children, are in general less strong than taller people. Advantageously in the present invention the effective diameter of the pulley will be larger for children than for adults, so stronger people will be able to use their strength to inflate tyres more quickly, whereas smaller people will still find that they have sufficient strength to inflate their tyres to high pressures.

The preferred embodiment of the present invention uses a standard cord with a circular cross section as illustrated. However, an alternative embodiment uses a fabric or plastic belt wrapped around the pulley, designed so that the width of the belt is slightly less than the gap between the flanges of the pulley. This makes the above effect more predictable, as the belt will wrap over itself in a more predictable manner than the way the circular cord wraps over itself on the pulley. Also, the cord tends to push sideways on the flanges of the pulley, so the flanges must be designed stiffly enough to resist this sideways loading—whereas a belt will tend to coil over itself flat, without putting any significant sideways loading on the flanges of the pulley.

The above text describes how the present invention enables the size of the apparatus to be reduced compared to the arrangement proposed in EP 0806568. Several factors prevent the size of the apparatus being reduced beyond a certain limit. The most significant of these is the number of turns that can be delivered by the spring. It is therefore essential in designing the apparatus for minimum size that the cord is not coiled around the outside of the spring as described in EP 0806568. Other factors limiting the reduction in size of the apparatus are material strength considerations, ergonomic considerations (the size of the footplate and the handle) and thermal considerations (since air compression generates heat, this must be dissipated adequately by the components of the apparatus).

In the preferred embodiment, said pump or compressor means comprises a double-ended piston, centrally driven by a cranked shaft with a bearing, said cranked shaft and bearing acting as a cam on a pair of followers, comprised of parallel internal faces of said piston.

In the preferred embodiment, said torque providing means comprises:

a retractor type spring.

In the preferred embodiment, said drive means further comprises:

a pulley arranged to have said pull-cord means wound thereon such that the pulling of a first end of the pull-cord means causes rotation of said pulley.

Also in the preferred embodiment, said transmission means comprises:

freewheel/clutch means or a ratchet arranged such that rotation of said pulley during re-winding is not transmitted to said first shaft.

Also in the preferred embodiment, said torque providing means is displaced from said pulley in a radial direction, said torque providing means is coiled around a second shaft, and the rotation of said pulley is linked to the rotation of said second shaft by means of a first spur gear mounted on said pulley and a second spur gear mounted on said second shaft.

The preferred embodiment of the present invention will now be described with reference to the first four accompanying drawings in which.

Figure 5:
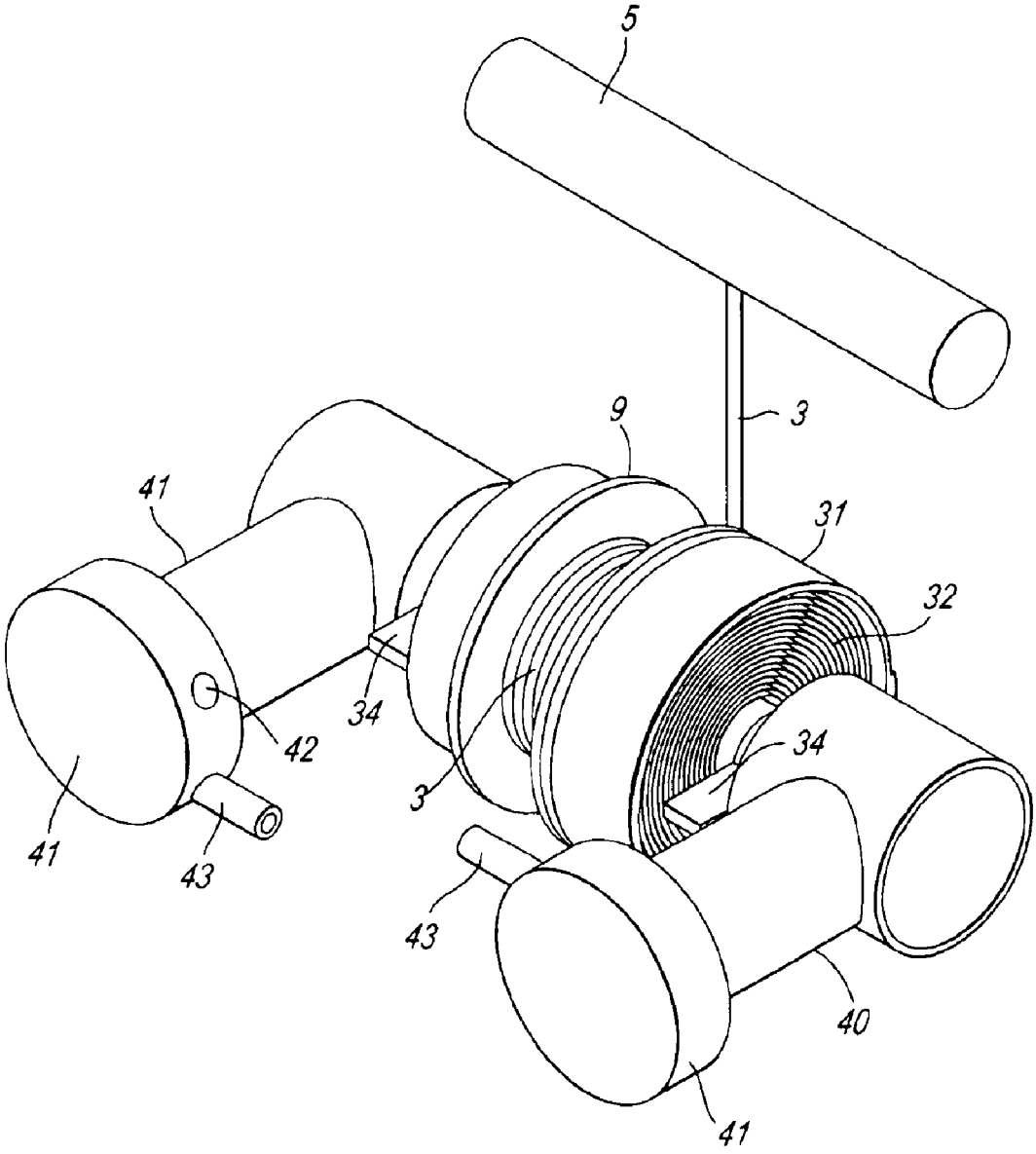

Later in the text, other embodiments will be described with reference to the other accompanying drawings in which:

FIG. 5 shows the assembled apparatus of the crankshaft embodiment, removed from its housing, without the hose and connector.

Figure 6:
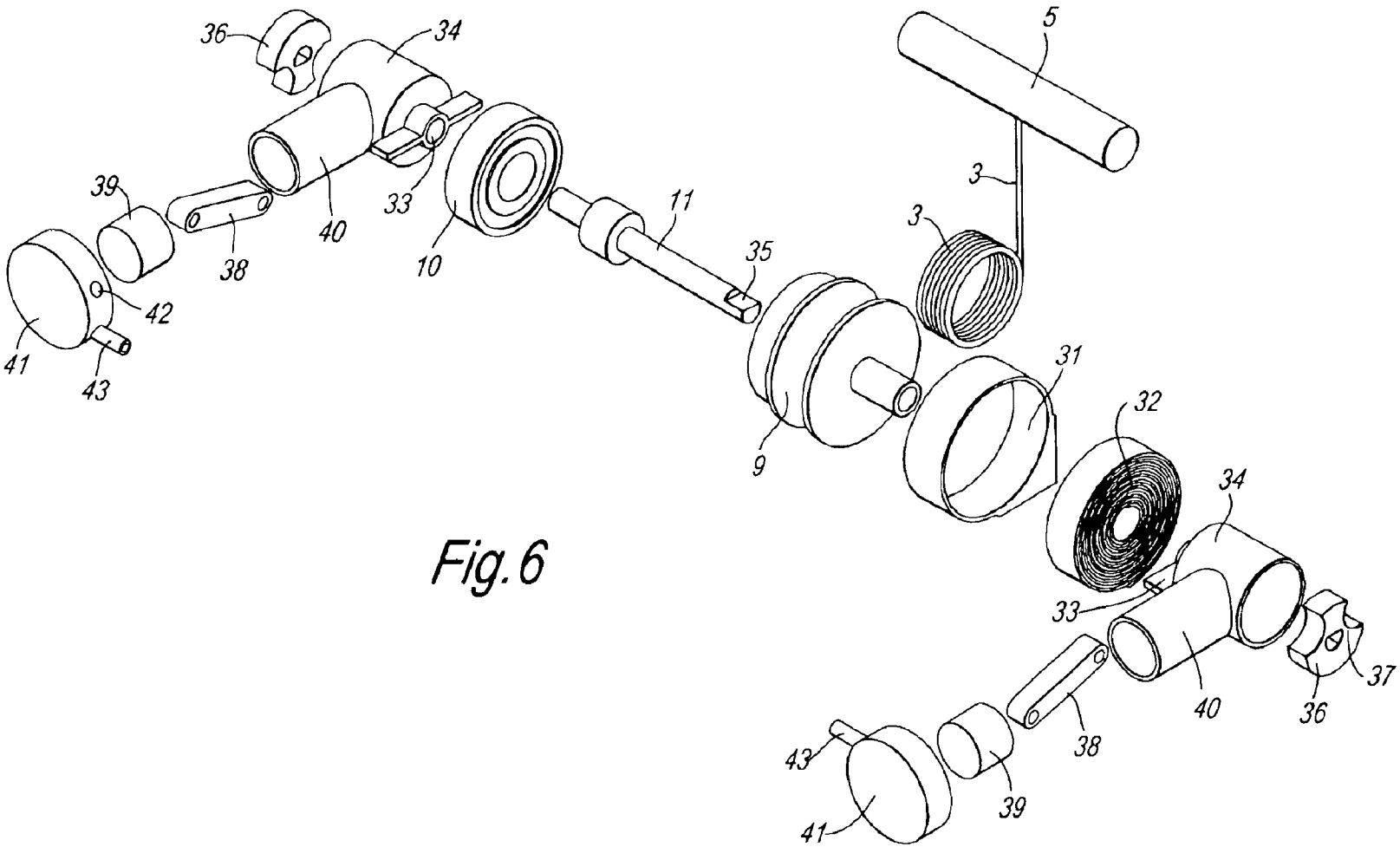

FIG. 6 shows an exploded view of the apparatus as shown in FIG. 5.

Figure 7:
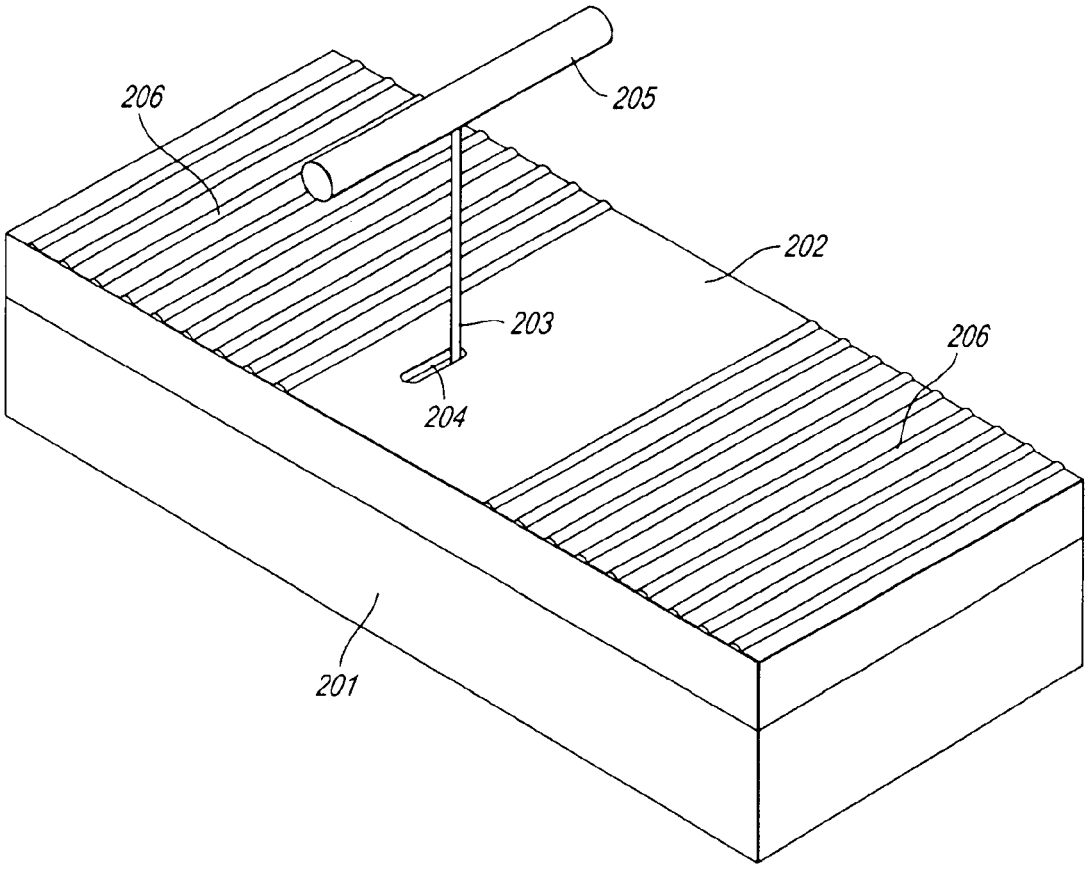

FIG. 7 shows the fully assembled apparatus of the Cam embodiment.

Figure 8:
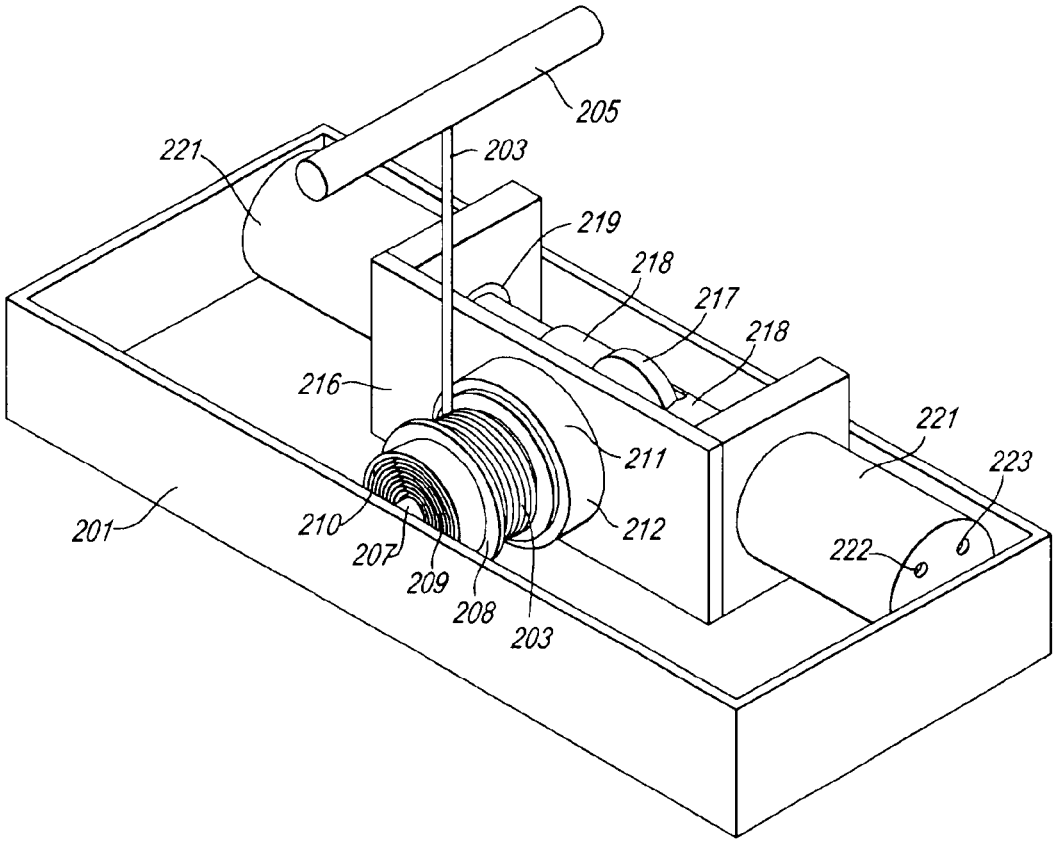

FIG. 8 shows the assembled apparatus of the Cam embodiment with the lid removed to show the main elements of the invention.

Figure 9:
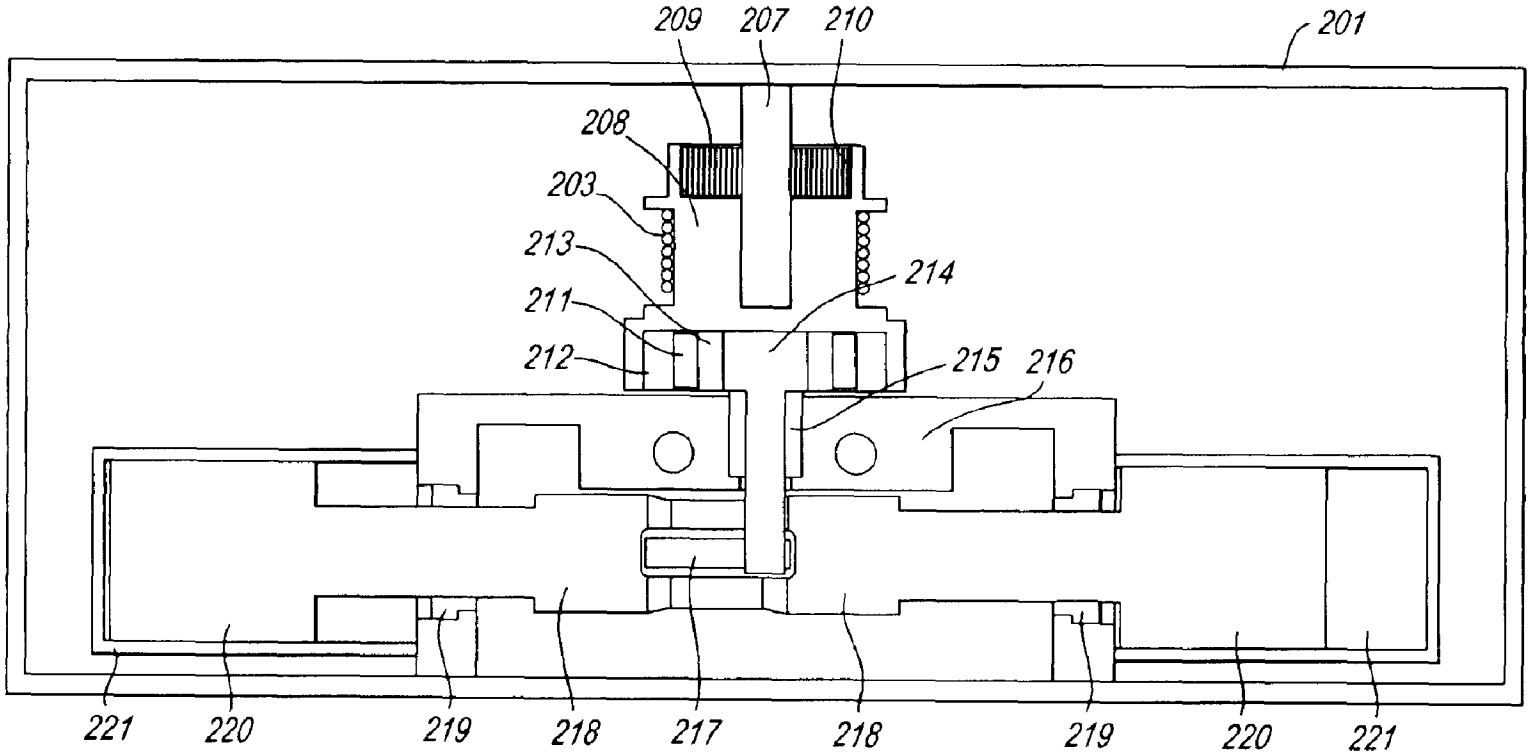

FIG. 9 shows a section through the assembled apparatus of the Cam embodiment.

Figure 10:
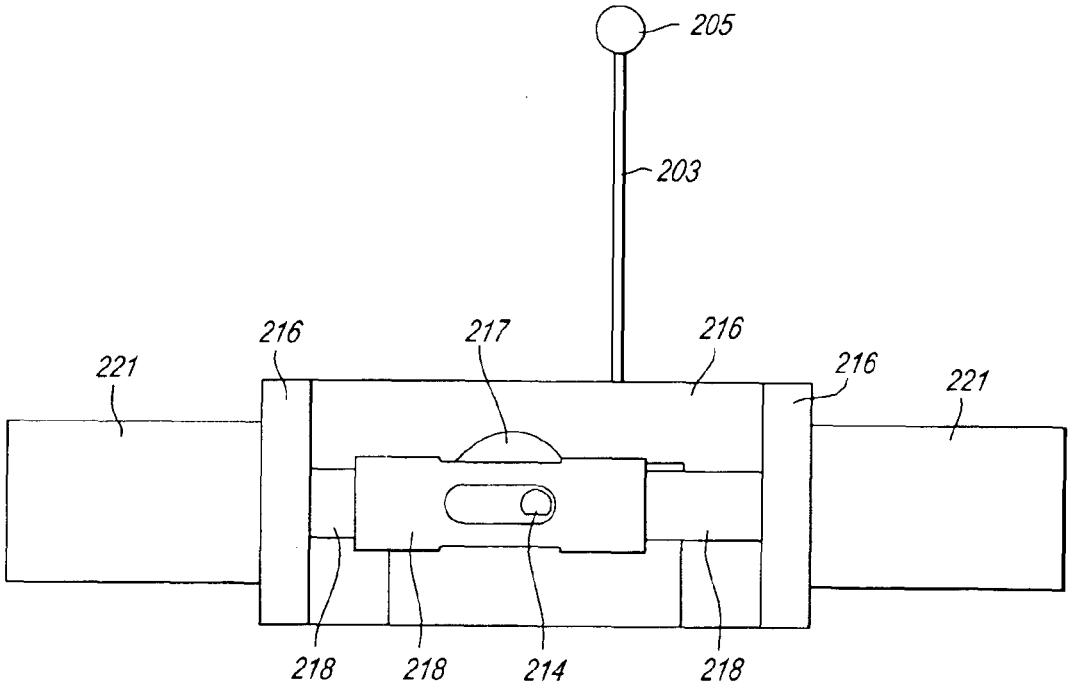

FIG. 10 shows the assembled apparatus of the Cam embodiment removed from the housing.

Figure 11:
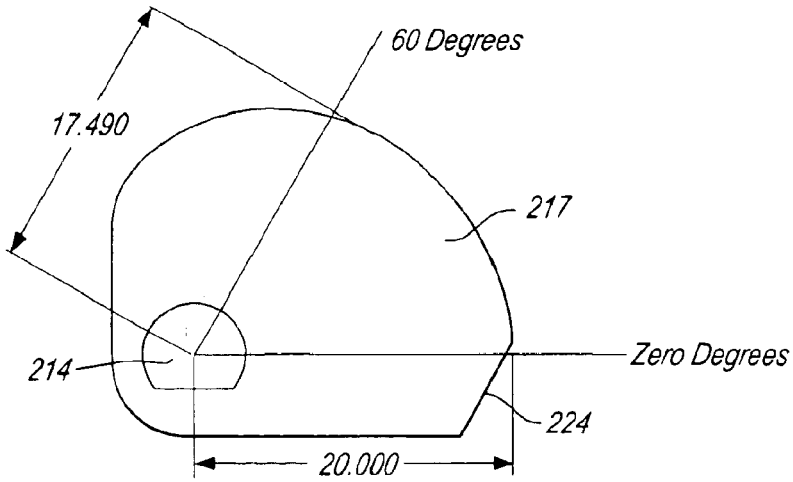

FIG. 11 shows a cam profile and construction data.

Figure 12:
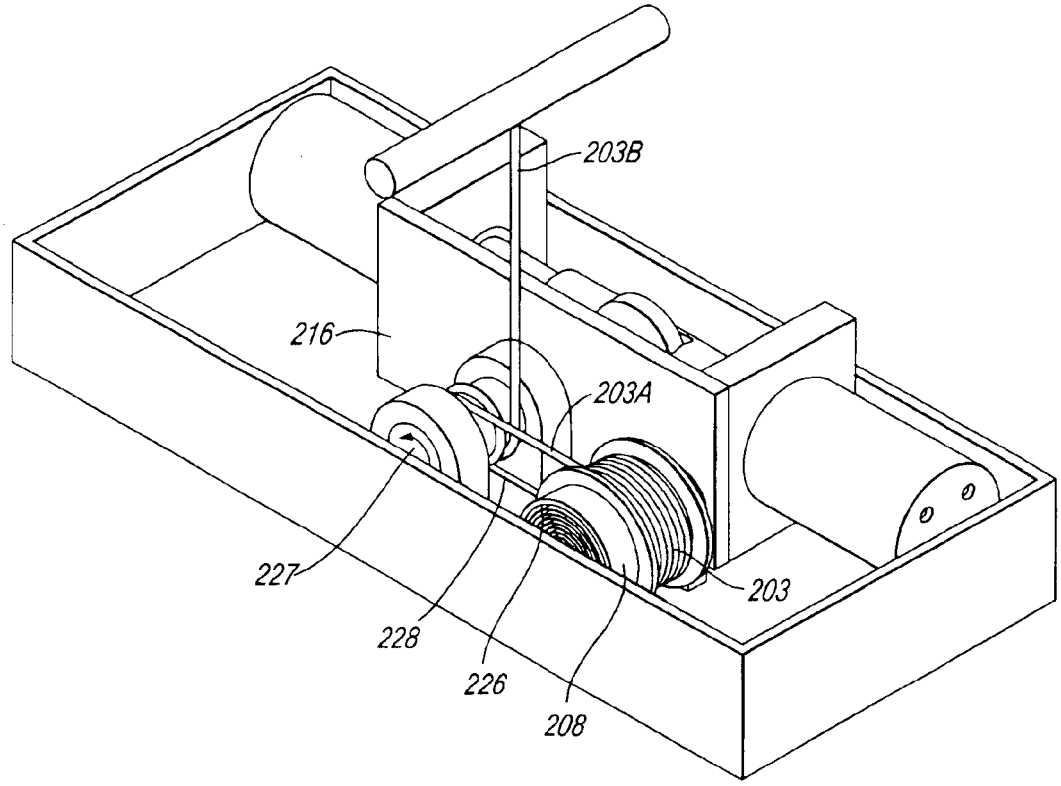

FIG. 12 shows an example of the clutchless version of the Cam embodiment.

Figure 13:
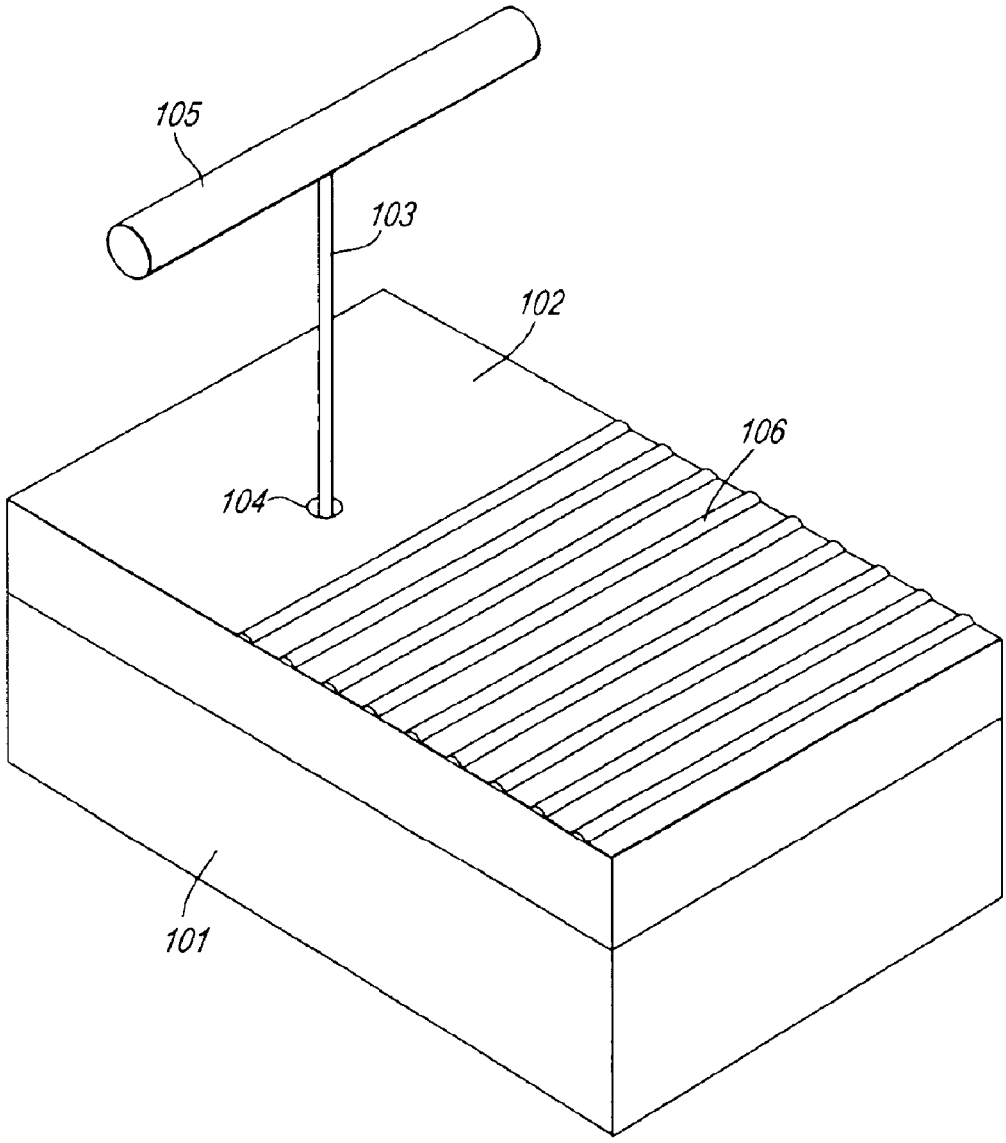

FIG. 13 shows the fully assembled apparatus of the Rotary Cleat embodiment.

Figure 14:
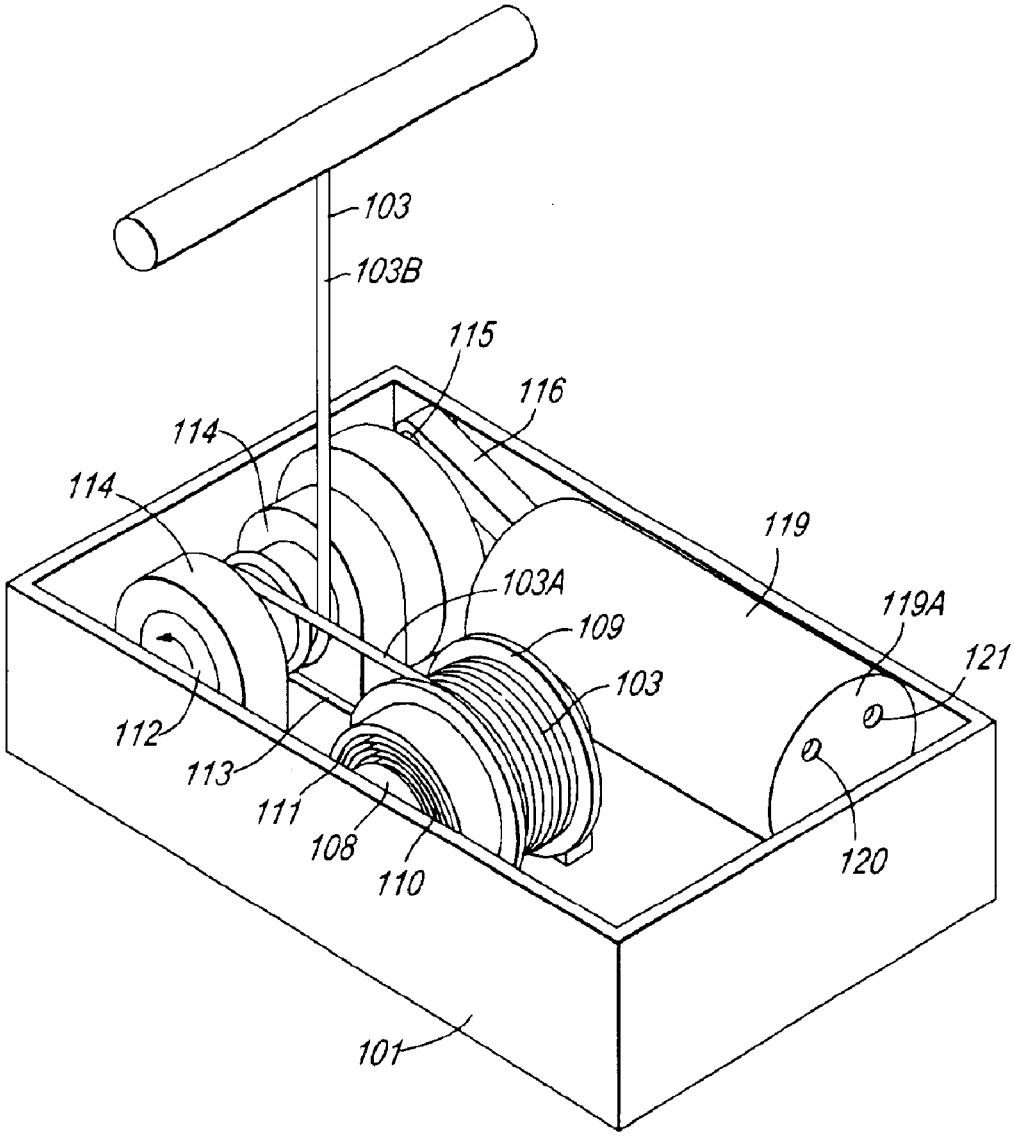

FIG. 14 shows the Rotary Cleat embodiment with the lid removed to show the main elements of the invention.

Figure 15:
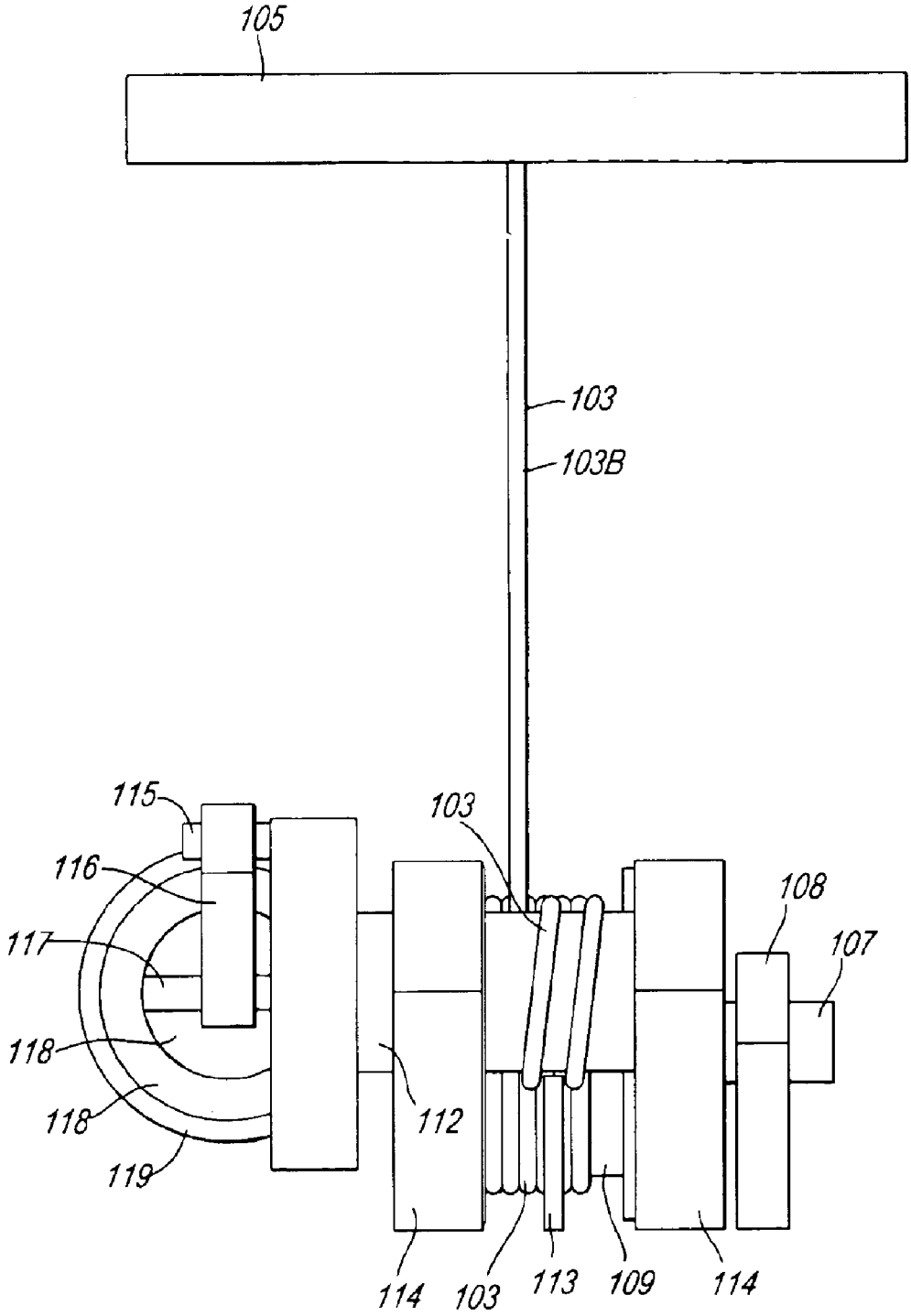

FIG. 15 shows the Rotary Cleat embodiment removed from the housing.

FIG. 16 shows cross sections through round, polygonal and asymmetric shafts.

Figure 17:
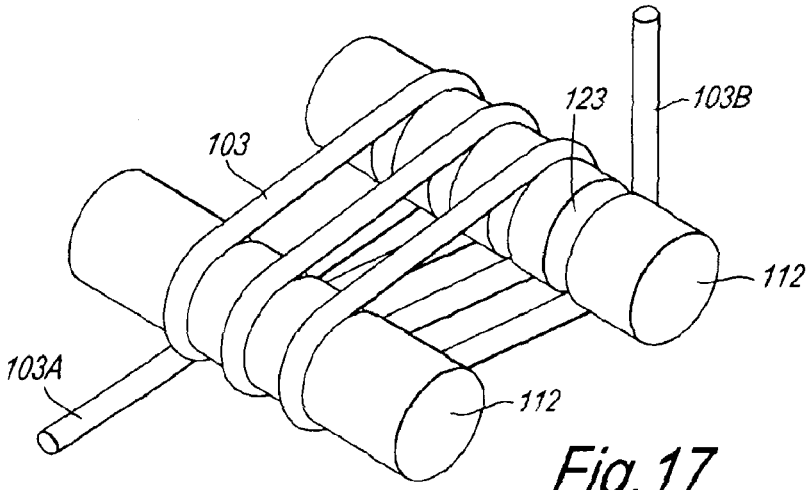

FIG. 17 shows a free shaft parallel to a main shaft.

The preferred embodiment of the present invention will now be described by reference to FIGS. 1 to 4.

Figure 1:
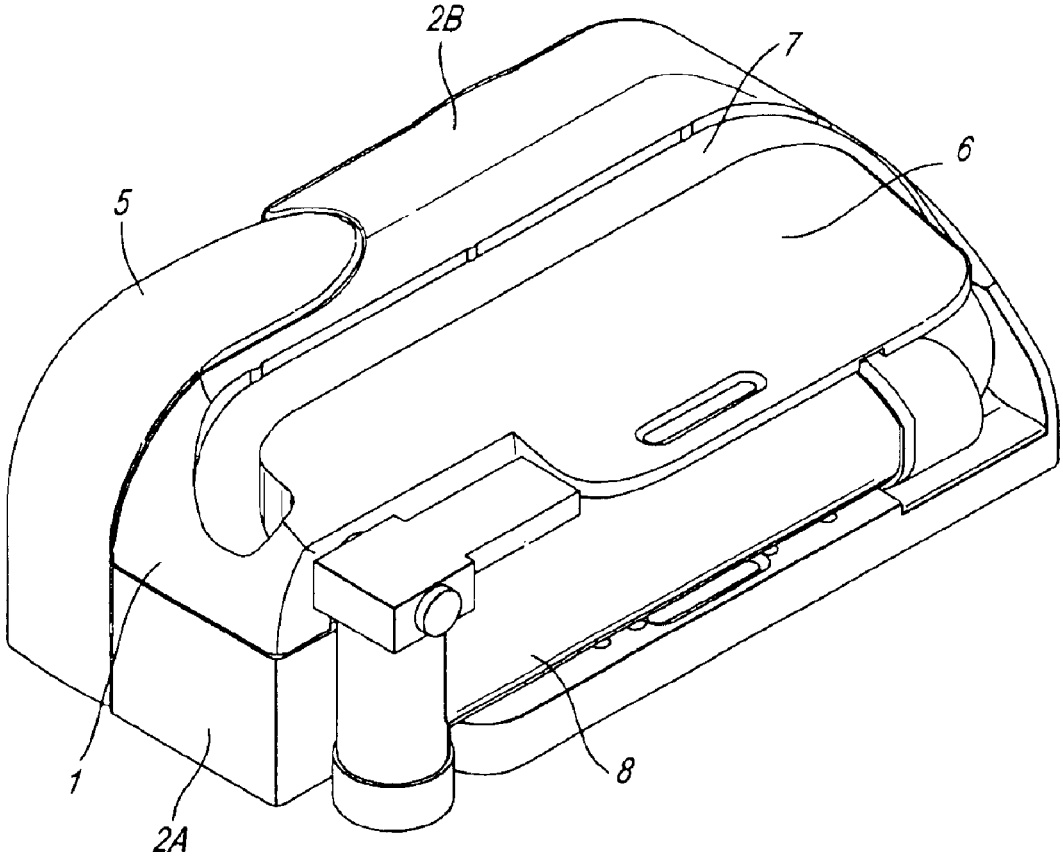
FIG. 1 shows the fully assembled apparatus.
Figure 2:
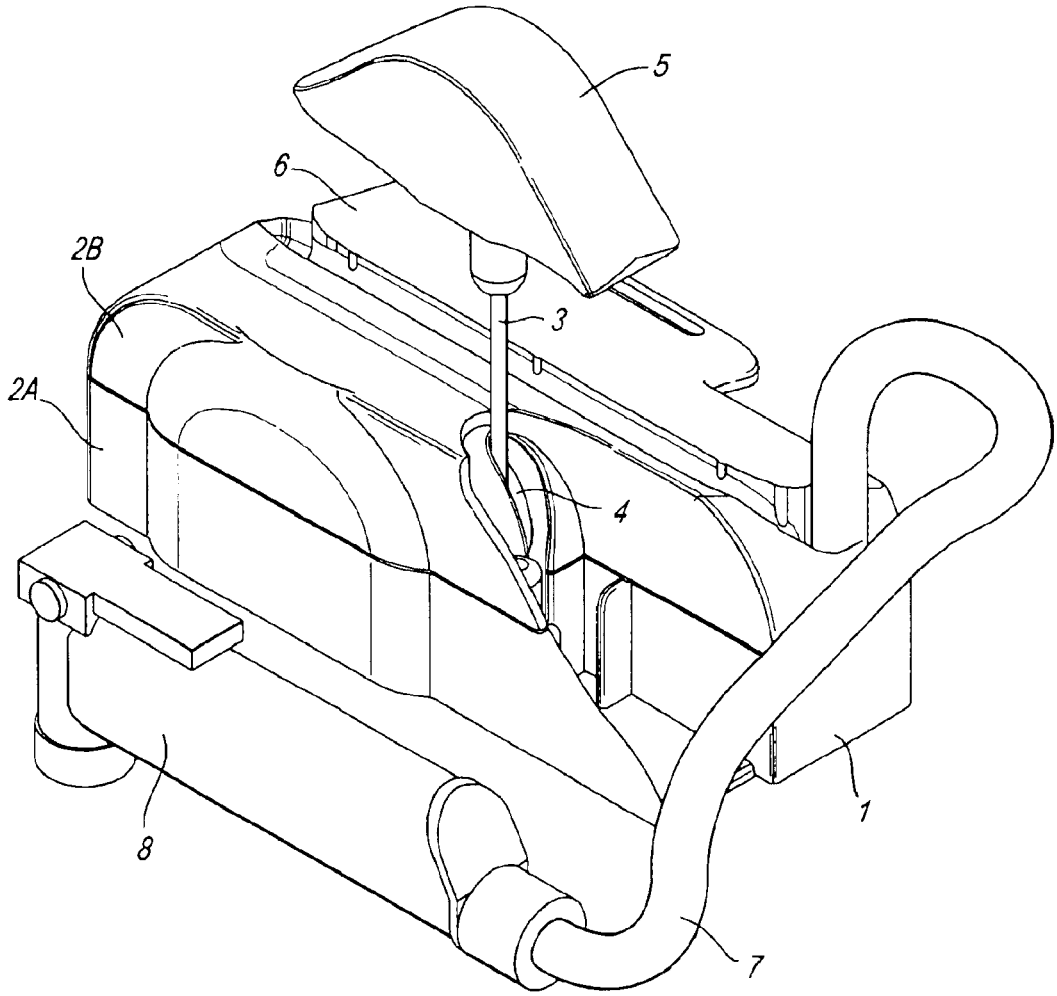
FIG. 2 shows the assembled apparatus in use, with the hose and connector out and the handle being pulled.

FIG. 1 shows that the apparatus is substantially contained inside a 'housing' 1 comprising a 'base' 2A and a 'lid' 2B. FIG. 2 shows a 'cord' 3 coming out through a 'hole' 4 in the lid 2B and the external end of the cord 3 is attached to a 'handle' 5. The lid 2B is designed with a 'footplate' 6 to enable a user to hold it in place on the ground with his foot, against the forces that will be applied to it as a result of tension being applied to the cord 3 by means of the handle 5. FIG. 2 also shows a pneumatic 'hose' 7 coupled to a 'connector' 8. The connector 8 can be coupled to a bicycle tyre and is adaptable for a Schrader or Presta type valve. The connector 8 may also incorporate a pressure gauge (not shown).

Figure 3:
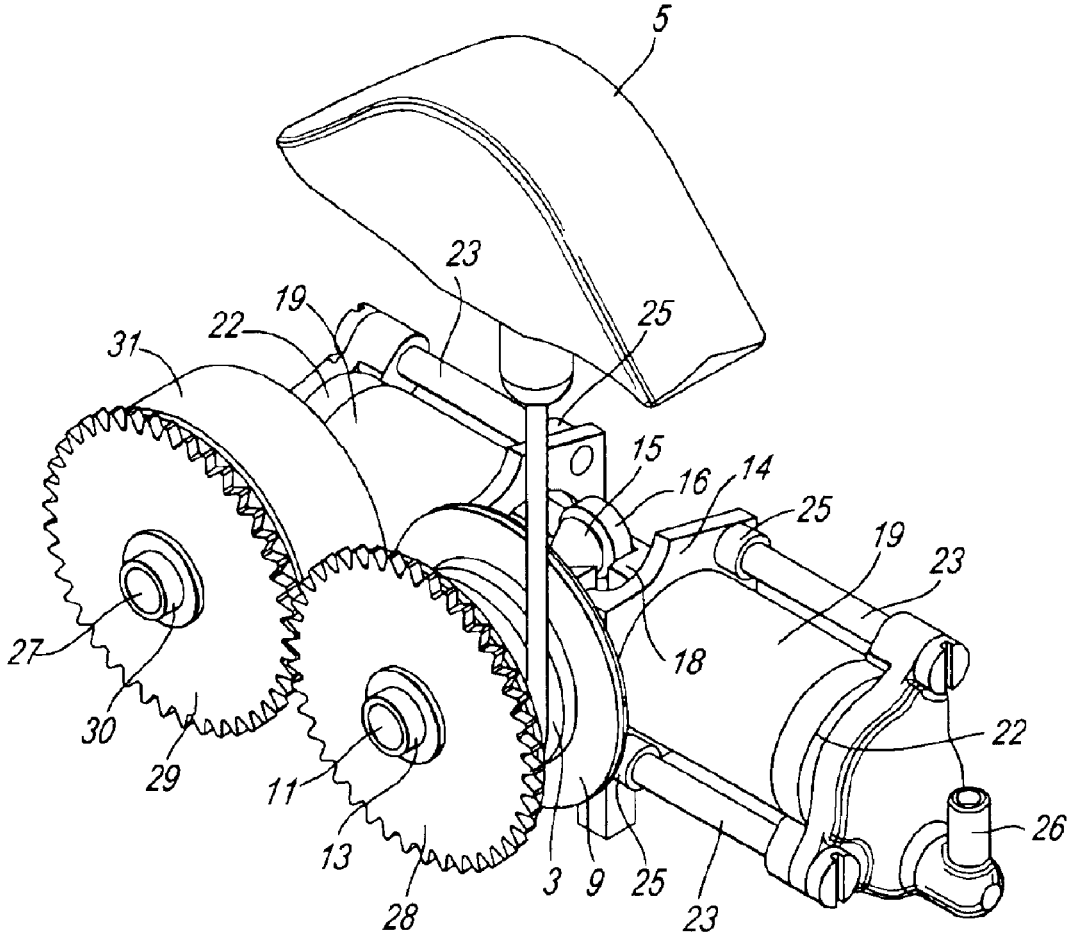
FIG. 3 shows the assembled apparatus removed from the housing, without the hose and connector.
Figure 4:
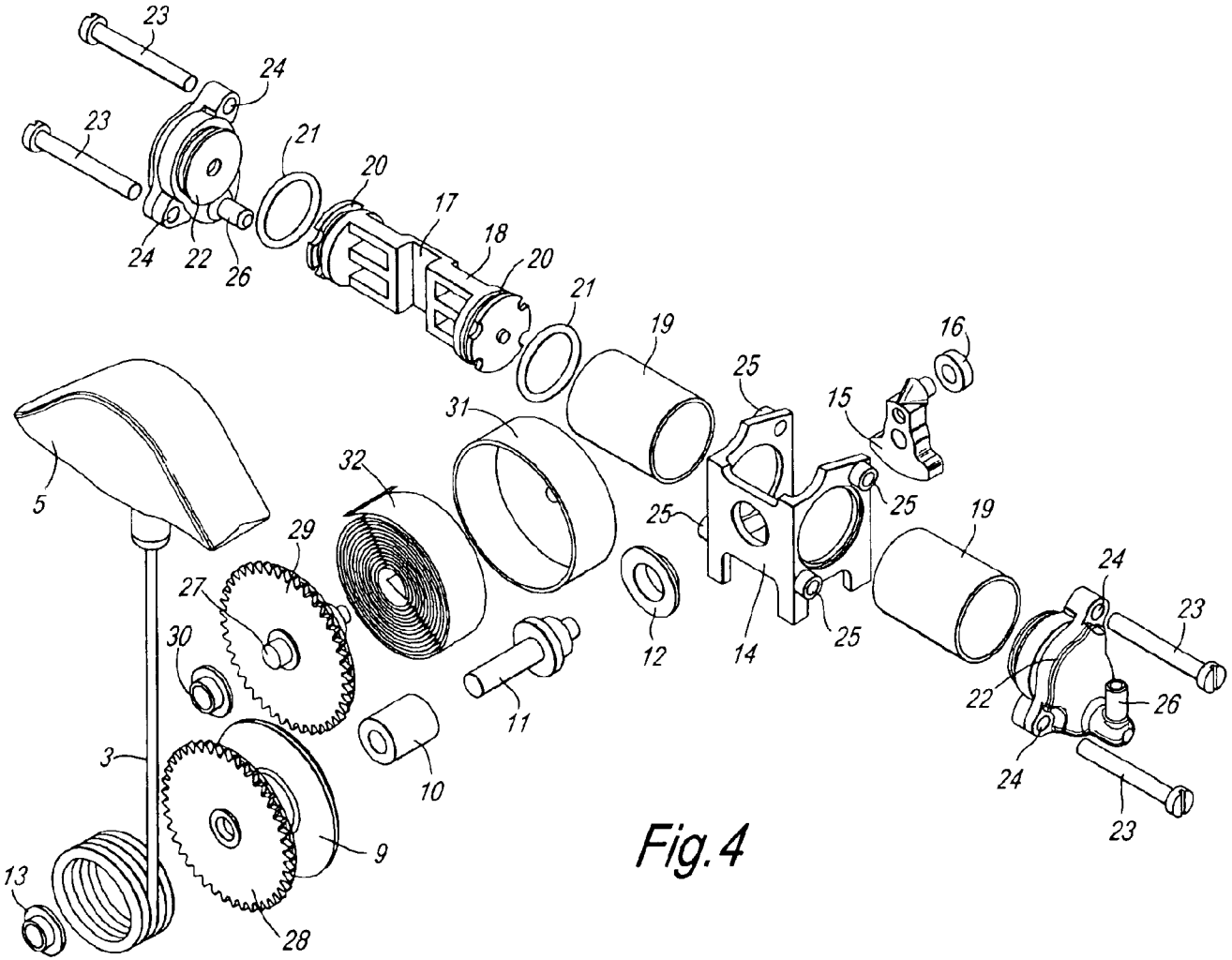
FIG. 4 shows an exploded view of the apparatus as shown in FIG. 3.

FIGS. 3 and 4 show the rest of the apparatus. The cord 3 is coiled around a pulley 9. One end of the cord 3 is attached to the handle 5 and the other end is attached to the pulley 9.

The pulley 9 is mounted on a 'freewheel clutch' 10 which is itself mounted on a 'main shaft' 11. The freewheel clutch 10 is arranged to allow the pulley 9 to rotate freely relative to the main shaft 11 in one direction, but to prevent rotation of the pulley 9 relative to the main shaft 11 in the opposite direction.

The main shaft 11 is mounted between a 'main bearing' 12 and a 'secondary bearing' 13. The main bearing 12 is mounted in a 'bracket' 14 and the secondary bearing 13 is captured between the base 2A and the lid 2B when these two parts are assembled. One end of the main shaft 11 is inside the secondary bearing 13.

To the other end of the main shaft 11 is attached a 'cam' 15, on which is mounted a 'cam bearing' 16. The cam bearing 16 is eccentric to the axis of the main shaft 11.

The cam bearing 16 fits in a 'recess' 17 in the centre of a 'piston' 18. The piston is free to reciprocate inside a pair of 'cylinders' 19. The cylinders 19 are mounted on the bracket 14, with their shared axis perpendicular to the axis of the main shaft 11.

Near each end of the piston 18 is a 'groove' 20 designed to accommodate an 'O-ring' 21 which forms a pneumatic seal between the piston 18 and the cylinder 19.

At the outer ends of each cylinder 19 is an 'end cap' 22 comprising an air inlet valve (not shown), an output valve (not shown) and means of forming a pneumatic seal between the end cap 22 and the cylinder 19.

The end caps 22 are held in place by means of 'screws' 23 which pass through 'clearance holes' 24 in the end caps 22 and are fastened into 'threaded holes' 25 in the bracket 14. The cylinders 19 are captured between the end caps 22 and the bracket 14.

The end caps 22 have 'outlet ports' 26 which connect them both to each other and to the hose 7.

Parallel to the main shaft 11 there is a 'second shaft' 27. The pulley 9 incorporates a 'first gear' 28 and the second shaft 27 incorporates a 'second gear' 29. The main shaft 11 and second shaft 27 are arranged such that the distance between them causes the first gear 28 permanently to mesh with the second gear 29.

The second shaft 27 is mounted between a 'spring bearing' 30 and a 'spring drum' 31. The spring bearing 30 is captured between the base 2A and the lid 2B when these two parts are assembled. The spring drum 31 is made of a plastic having some bearing properties so that it provides a second bearing for the second shaft 27.

A 'main spring' 32 is a retractor type spring and is coiled inside the spring drum 31. One end of the main spring 32 is attached to the perimeter of the spring drum 31 and the other end is attached to the second shaft 27 so that it provides a torque between these two components.

The components of the apparatus described above are arranged such that when the handle 5 is being pulled away from the pulley 9, the freewheel clutch 10 locks and prevents rotation of the pulley 9 relative to the main shaft 11, and the rotation of the second shaft 27 relative to the spring drum 31 increases the tension in the main spring 32. Likewise, when the handle 5 is moved back towards the pulley 9, the main spring 32 releases its tension, causing the pulley 9 to rotate relative to the main shaft 11 because the freewheel clutch 10 releases in this direction. This causes the cord 3 to rewind onto the pulley 9.

The apparatus is assembled such that there is, at all times, some tension in the main spring 32. The coupling of the main spring 32 to the pulley 9 via the first gear 28 and second gear 29 ensures that this tension is always transferred to the cord 3.

The operation of this embodiment, used to inflate a bicycle tyre will now be described with reference to FIGS. 2 to 4.

The apparatus is placed on the ground near to the tyre to be inflated and the connector is attached to the tyre valve. The apparatus should be close enough to the tyre for the hose not to be unduly stressed. The user places his/her foot on the footplate to hold the apparatus in place and then grasps the handle in his/her hand.

The user then repeatedly pulls on the handle causing the cord to unwind from the pulley, then releases the handle and lets the main spring recoil the cord back on to the pulley. When the user is pulling the handle, the cord unwinds from the pulley and the pulley drives the main shaft through the freewheel clutch. The main shaft causes the cam and cam bearing to rotate, and the cam bearing acts alternately on the opposing faces of the central recess in the piston, causing the piston to reciprocate inside the cylinders. As the piston moves towards one end cap, the air in the cylinder between the piston and the end cap is compressed and causes the output valve to open, enabling this compressed air to flow out through the end cap, the outlet port, the hose, the connector and the tyre valve and into the tyre.

After the piston passes over top dead centre, it starts to move away from the end cap. This causes the outlet valve to close and the inlet valve to open, allowing air to flow into the cylinder from outside. This continues until the piston reaches bottom dead centre, when the inlet valve closes and the piston starts to move back towards the end cap, compressing the air in the cylinder again.

The two ends of the piston operate in anti-phase, so that as one end is compressing air, the other end is drawing air in and vice-versa.

Also as the user pulls the handle, the rotation of the pulley is transferred by the first gear and second gear to the spring shaft. As the spring shaft rotates, it increases the tension in the main spring. This continues until the user reaches the end of the pull stroke.

At the end of the pull stroke, the main spring is under tension and this tension is transferred to the cord by the first gear and second gear. The user moves the handle back towards the apparatus, and the tension in the spring causes the cord to be recoiled back onto the pulley. During this part of the process, the freewheel clutch is released so the main shaft and piston remain idle during the recoiling of the cord onto the pulley.

The user may take as many strokes as are required, repeatedly pulling the cord and letting the cord be recoiled by the spring, until the user is satisfied that there is enough air in the tyre. A pressure gauge may be fitted to the apparatus to assist in judging this. The connector can then be detached from the Schrader or Presta valve and the tyre inflation process is complete.

In the context of the design objectives for bicycle pumps listed earlier, the present invention has a significant advantage over the prior art, and in particular over the arrangement proposed in EP 0806568. The problem with earlier rope driven pumps is that the arrangements proposed have caused the pumps to be too large, too heavy or too expensive to be commercially viable. EP 0806568 shows the main spring to be coiled inside the pulley, which is an obvious way to save space in the overall arrangement. However, the present invention actually saves space by the counter-intuitive step of separating the spring from the pulley, increasing the outer diameter of the spring drum and thereby reducing the inner diameter of the pulley.

The reason that this enables the overall size of the apparatus to be reduced is that the separation of the spring from the pulley allows the free and independent design of these two critical components. The use of a larger diameter spring enables the spring to provide a larger number of turns. However, in EP 0806568, this would provide no benefit as it would increase the diameter of the pulley—which would reduce the number of turns of the cord, for a given length of pull. According to the present invention, the diameter of the spring can be increased, to increase the number of turns available, and the diameter of the pulley can be reduced, so that for a given length of pull the pulley will turn through a larger number of revolutions.

In order to inflate a bicycle tyre, a certain volume of free air needs to be compressed, according to the size of the tyre and the pressure required. It would be advantageous to achieve this with as few pulls of the cord as possible. The present invention allows a larger volume of free air to be compressed for each pull of the cord—or it allows the size of the cylinders to be reduced without diminishing the amount of air transferred by each pull of the cord. Since the cylinders are some of the largest components in the apparatus, this enables the overall size of the apparatus to be reduced.

The apparatus proposed in EP 0806568 does not allow a large volume of free air to be compressed for each pull of the cord, unless the cylinder used is large. If a large cylinder is used, the apparatus becomes larger, and it will become difficult to pull the cord at high pressures.

The present invention allows the cord to be wrapped initially around a small pulley diameter, so that when most of the cord has been uncoiled off the pulley, a large volume of air is compressed for a given length of pull on the cord. However, as the cord recoils onto the pulley, the effective diameter of the pulley increases. The effect of this is that with the larger effective diameter, less air is compressed for a given length of pull on the cord.

This will be the case when most of the cord is coiled around the pulley, which will happen when the handle is close to the apparatus. Therefore the cord will be easy to pull and the pump will run slowly when the handle is close to the apparatus. This is advantageous because it makes it easier to start the pump (overcoming any stiction, and building up some initial momentum) and because it makes the pump easier to use for smaller people, especially children.

Once the pulley and main shaft are rotating, the system has some momentum and initial stiction has been overcome. It is therefore advantageous that the effective diameter of the pulley reduces as the cord unwinds from it, causing more air to be compressed for a given length of pull on the cord.

A further advantage of this effect arises because people vary in size: and smaller people, especially children, are in general less strong than taller people. Advantageously in the present invention the effective diameter of the pulley will be larger for children than for adults, so stronger people will be able to use their strength to inflate tyres more quickly, whereas smaller people will still find that they have sufficient strength to inflate their tyres to high pressures.

The preferred embodiment of the present invention uses a standard cord with a circular cross section as illustrated. However, an alternative embodiment uses a fabric or plastic belt wrapped around the pulley, designed so that the width of the belt is slightly less than the gap between the flanges of the pulley. This makes the above effect more predictable, as the belt will wrap over itself in a more predictable manner than the way the circular cord wraps over itself on the pulley. Also, the cord tends to push sideways on the flanges of the pulley, so the flanges must be designed stiffly enough to resist this sideways loading—whereas a belt will tend to coil over itself flat, without putting any significant sideways loading on the flanges of the pulley.

The above text describes how the present invention enables the size of the apparatus to be reduced compared to the arrangement proposed in EP 0806568. Several factors prevent the size of the apparatus being reduced beyond a certain limit. The most significant of these is the number of turns that can be delivered by the spring. It is therefore essential in designing the apparatus for minimum size that the cord is not coiled around the outside of the spring as described in EP 0806568. Other factors limiting the reduction in size of the apparatus are material strength considerations, ergonomic considerations (the size of the footplate and the handle) and thermal considerations (since air compression generates heat, this must be dissipated adequately by the components of the apparatus).

Some other embodiments of the present invention will now be described.

Although the preferred embodiment describes a reciprocating pump, the present invention is not limited to reciprocating pumps. In particular, the main shaft may be connected to a rotary pump. In the twin screw embodiment, Roots blower embodiment, gear pump embodiment and rotary tooth embodiment of the present invention, the output shaft is connected to one shaft of the compressor and the other shaft of the compressor is driven by a set of timing gears or similar mechanism operating between the two shafts.

In the scroll embodiment of the present invention, the main shaft is connected to the shaft of a scroll compressor.

Although the preferred embodiment is a two cylinder embodiment, the apparatus may comprise just one cylinder, or it may comprise more than two cylinders.

The preferred embodiment describes a single piston driven by a cam bearing rotating on a cam attached to a main shaft. In the profiled cam embodiment, the piston is driven by a profiled cam instead of by a circular cam to smooth the action of the apparatus as the shaft revolves. This has the advantage of allowing the cyclical forces to be smoothed out, at least to some extent, thereby making the apparatus feel less jerky, and also reducing the peak stresses in the apparatus.

Likewise, in the profiled piston embodiment, the inner faces of the recess in the piston are profiled to smooth the action of the apparatus as the shaft revolves, which provides the same benefits as in the profiled cam embodiment.

The crankshaft embodiment of the present invention differs significantly from the preferred embodiment and will now be described by reference to FIGS. 5 and 6.

FIGS. 5 and 6 show a cord 3 wrapped around a pulley 9, with one end of the cord 3 attached to a handle 5 and the other end attached to the pulley 9.

The pulley 9 is mounted on a freewheel clutch 10 which is itself mounted on a main shaft 11. The freewheel clutch 10 is arranged to allow the pulley 9 to rotate freely relative to the main shaft 11 in one direction, but to prevent rotation of the pulley 9 relative to the main shaft 11 in the opposite direction.

There is a main spring 32 housed inside a spring drum 31, such that one end of the main spring 32 is attached to the pulley 9 and the other end of the main spring 32 is attached to the spring drum 31. The spring drum 31 is mounted in the housing (not shown) so that the main spring 32 provides a torque between the pulley 9 and the housing. Both the pulley 9 and the main shaft 11 are otherwise free to rotate relative to the spring drum 31.

The main shaft 11 is mounted between a pair of 'main bearings' 33, each of which forms part of a 'bracket' 34. Both brackets 34 are fixed relative to the housing.

Each end of the main shaft 11 has a 'cutout' 35 to form a D-shape to prevent a pair of 'cranks' 36 from rotating relative to the main shaft 11. The cranks 36 are mounted in anti-phase (rotated 180 degrees) relative to each other on the main shaft 11. Each crank 36 has an eccentric 'spigot' 37, on which is mounted one end of a 'connecting rod' 38. The other end of each connecting rod 38 is rotatably mounted in a recess (not shown) in the back of each 'piston' 39.

Each piston 39 further comprises a piston seal (not shown) similar to that shown in FIGS. 3 and 4

Each bracket 34 further comprises a 'cylinder' 40, within which the piston 39 is free to reciprocate. At the end of each cylinder 40 there is an 'end cap' 41, pneumatically sealed to said cylinder 40. Tie rods (not shown) connect each end cap 41 to its bracket 34 in a manner similar to that shown in FIGS. 3 and 4.

Each end cap 41 has an 'inlet valve' 42 and an 'outlet valve' 43.

The components of the apparatus described above are arranged such that when the handle 5 is being pulled away from the pulley 9, the freewheel clutch 10 locks and prevents rotation of the pulley 9 relative to the main shaft 11, and the rotation of the main shaft 11 relative to the spring drum 31 increases the tension in the main spring 32. Likewise, when the handle 5 is moved back towards the pulley 9, the main spring 32 releases its tension, causing the pulley 9 to rotate relative to the main shaft 11 because the freewheel clutch 10 releases in this direction. This causes the cord 3 to rewind onto the pulley 9.

The apparatus is assembled such that there is, at all times, some tension in the main spring 32. The coupling of the main spring 32 to the pulley 9 ensures that this tension is always transferred to the cord 3.

Whilst no housing is shown for the crankshaft embodiment, it will be appreciated that the apparatus should be contained inside a housing similar to that shown in FIGS. 1 and 2 for the preferred embodiment.

The operation of the crankshaft embodiment is similar to the operation of the preferred embodiment, and will not be described here in further detail.

It is apparent that there are two essential differences between the preferred embodiment and the crankshaft embodiment. Firstly, the preferred embodiment operates with a cam whereas the crankshaft embodiment operates with a system of crankshafts. Secondly, the preferred embodiment has the main spring separated radially from the pulley, whereas the crankshaft embodiment has the main spring separated axially from the pulley. It is evident that these concepts could therefore be combined in two other ways.

Firstly, there is the co-axial version of the preferred embodiment. This comprises a cam-driven pump mechanism as illustrated in FIGS. 1 to 4, but instead of the main spring being on a second shaft, the main spring is on the main shaft as shown in the crankshaft embodiment, FIGS. 5 and 6.

Secondly there is the crankshafts and gears embodiment, in which the crankshafts arrangement shown in FIGS. 5 and 6 is combined with the spring and pulley arrangement shown in FIGS. 1 to 4.

The above embodiments describe situations in which the spring is displaced from the pulley in either an axial or a radial direction. It will also be apparent that the spring could be not only displaced but also rotated by a small or large angle. In particular, the spring could be rotated through 90 degrees so that the axis of the spring shaft could be orthogonal to the axis of the main shaft.

In the ratchet embodiment, the freewheel clutch is replaced by a ratchet system.

In the reduction embodiment, the number of teeth on the second gear is greater than the number of teeth on the first gear. The effect of this is that the number of rotations of the main pulley is greater than the number of rotations of the spring shaft. This is an advantage as spiral springs cannot generally provide more than about 30–40 turns, but it may be desirable to have more than this number of turns of cord on the pulley.

The three shaft embodiment is a particular example of the reduction embodiment. In the reduction embodiment as already described, the second gear has more teeth than the first gear. It will therefore have a larger diameter than the first gear. In accordance with the objective of reducing the overall size of the apparatus, it would be better to reduce the size of the first gear than to increase the size of the second gear. However, this will cause an interference between the spring drum and the pulley, unless a third shaft and a third gear are also introduced. If this third shaft and gear are positioned closer to the main shaft than to the spring shaft and the gears are arranged so that both the first gear and second gear mesh with the third gear (but not with each other), then the number of rotations of the main pulley can be made greater than the number of rotations of the spring shaft, without having to increase the diameter of either the first gear or the second gear.

In the timing belt embodiment, the linkage between the rotation of the main pulley and the spring shaft is provided by both the main pulley and spring shaft incorporating sprockets instead of gears. These two sprockets are then coupled to each other by a timing belt. As in the reduction embodiment, this allows the number of teeth on the second sprocket to be greater than the number of teeth on the first sprocket, so that the number of rotations of the main pulley can be greater than the number of rotations of the spring shaft.

In the rubber band embodiment, a rubber band is used to replace the main spring. The rubber band is held in tension between two hooks, one of which is attached to the spring shaft and the other of which is rigidly attached to the housing. The rubber band becomes twisted as the hooks rotate relative to each other, creating a torque between the two hooks.

In the torsion rod embodiment, a torsion rod is used to replace the main spring. It is highly unlikely that a torsion rod could accommodate anything like 30–40 turns, so this would work best in conjuction with the reduction embodiment, the three shaft embodiment or the timing belt embodiment.

The Cam embodiment is an important example of the present invention. The next 5 pages of the main description describe the Cam embodiment of the present invention.

According to the Cam embodiment of the present invention there is provided apparatus for movement or compression of a fluid comprising:

pump or compressor means arranged to receive a mechanical rotational drive input by way of an input rotary shaft; and drive means arranged to provide said drive input;

said drive means comprising a pull-cord means and means for transferring movement of said pull-cord means to rotation of said rotary shaft when an end of said pull-cord means is pulled by a user; and said pump or compressor means comprising a piston movable axially within a cylinder, cam means arranged to rotate with said rotary shaft and cam follower means arranged to interact with said cam means and to actuate said piston.

Said cam follower means may be fixed in relation to said piston, and may even be formed integrally with said piston.

The apparatus may comprise a plurality of said pistons. For example, the apparatus may comprise two said pistons arranged to move in respective cylinders on a common axis but in anti-phase.

In one preferred embodiment, said drive means comprises:

a pulley arranged to have said pull-cord means wound thereon such that the pulling of a force end of the pull-cord means causes rotation of said pulley;

transmission means arranged to transmit said rotation of said pulley to said rotary shaft; and spring means arranged to re-wind said pull-cord means onto said pulley;

wherein said transmission means comprises freewheel/clutch means arranged such that rotation of said pulley during re-winding is not transmitted to said rotary shaft.

In another preferred embodiment, said drive means comprises:

a rotary part round which said pull-cord means is arranged to pass such that application of tensile force by a user to one end of said pull-cord means causes rotation of said rotary part; and transmission means arranged to transmit said rotation of said rotary part to said rotary shaft.

The Cam embodiment of the present invention will now be described with reference to FIGS. 7 to 10.

FIG. 7 shows that the apparatus is substantially inside a 'housing' 201 contained by a 'lid' 202. A 'cord' 203 is shown coming out through a 'hole' 204 in the lid 202 and the external end of the cord 203 is attached to a 'handle' 205. The lid 202 is designed with two 'footplates' 206 to enable an operator to hold it in place on the ground with his/her foot, against the forces that will be applied to it as a result of tension being applied to the cord 203 by means of the handle 205.

FIGS. 8 to 10 show the rest of the apparatus. Firstly there is shown a 'fixed shaft' 207 mounted on the side of the housing 1 and terminating inside a 'pulley' 8. The pulley 8 is rotatably mounted on the fixed shaft 207 and a 'coiled spring' 209 creates a torque between the fixed shaft 207 and the pulley 208.

The coiled spring 209 is reverse coiled inside a 'recess' 210 in the pulley 208 and the outer end of the coiled spring 209 is attached to the inside of the recess 210 in the pulley 208. The inner end of the coiled spring 209 is attached to the fixed shaft 207.

Around the outside of the pulley 208 is wound the cord 203, one end of which is attached to the outside of the pulley 208. The cord 203 passes through the hole 204 in the lid 202. The cord 203 is wrapped around the pulley 208 in such a direction that the effect of the coiled spring 209 is apply a torque to the pulley 208 in such a way as to cause the cord 203 to coil itself around the pulley 208 in the absence of any tensile force being applied to the cord 203. The apparatus is set up initially with a small amount of residual tension in the coiled spring 209 creating a corresponding amount of tension in the cord 203 when the handle 205 is pulled right in to the hole 204 in the lid 202.

A 'freewheel clutch' 211 is free to rotate about the axis of the fixed shaft 207. The 'outer race' 212 of the freewheel clutch 211 is attached to the pulley 208 and the 'inner race' 213 of the freewheel clutch 211 is connected to a 'rotating shaft' 214, co-axial with the fixed shaft 207. The freewheel clutch 211 is set up so that when the cord 203 is pulled by the handle 205, the inner race 213 will not rotate relative to the outer race 212 and the entire freewheel clutch 211 will therefore rotate with the pulley 208, but when the coiled spring 209 causes the pulley 208 to rotate in the opposite direction to recoil the cord 203 the inner race 213 is free to rotate relative to the outer race 212, so the outer race 212 rotates with the pulley 209 while the inner race 213 remains stationary.

The rotating shaft 214 passes through a 'bearing' 215 in a 'bracket' 216 and carries a 'cam' 217 which lies inside a 'reciprocating shaft' 218, between two parallel faces which behave as flat followers on the cam 217. The reciprocating shaft 218 is free to slide through 'slide bearings' 219 in the bracket 216. Each end of the reciprocating shaft 218 terminates in a 'piston' 220, free to reciprocate inside a 'cylinder' 221. A seal (not shown) forms an air-tight seal between tie piston 220 and the cylinder 221. At the other end of each cylinder 221 there is an 'inlet valve' 222 arranged to draw air into the cylinder 221 from the atmosphere and an 'outlet valve' 223 arranged to deliver compressed air into a hose (not shown) from the cylinder 221. The other end of the hose is fitted with an appropriate coupling (not shown) to enable it to be attached with an airtight seal to an appropriate valve. In the context of bicycle tyres, this is likely to be a Schrader or Presta valve.

The profile of the cam is designed to smooth out the jerkiness that would arise if a simple crankshaft and connecting rod system were used to drive the pump. The nature of this cam profile will be described in more detail later.

The operation of this embodiment, used to inflate a bicycle tyre will now be described with reference to FIGS. 8 to 10.

The apparatus is placed on the ground near to the tyre which is to be inflated and the coupling is attached to the tyre valve. The apparatus should be close enough to the tyre for the hose not to be unduly stressed. The operator places his/her foot on the footplate to hold the apparatus in place and then grasps the handle in his/her hand.

The operator then repeatedly pulls on the handle allowing the cord to unwind from the pulley, then releases the handle and lets the coiled spring recoil the cord back on to the pulley. This is described in detail in the paragraphs below.

As the operator pulls on the handle, the cord unwinds from the pulley and as the pulley rotates the tension increases in the spring. Also, as the pulley rotates in this direction the freewheel clutch is locked so the inner race of the freewheel clutch causes the cam to rotate about the axis of the rotating shaft. The cam rotates between the parallel faces of the reciprocating shaft and acts alternately first on one face then on the other, pushing the reciprocating shaft first one way then the other. As the reciprocating shaft moves, it will push one of the pistons within one of the cylinders, compressing the air therein and ultimately expelling the compressed air through the outlet valve, into the hose and thence via the coupling and the Schrader or Presta valve into the tyre itself. Simultaneously, the other piston moves away from its valves, initially pushed by residual high pressure air in the cylinder, then pulled by the reciprocating shaft. As it moves along the cylinder, the inlet valve will open allowing air to flow freely into the cylinder. The process then repeats itself, as long as the cord is being pulled.

As the operator starts to release the handle, the coiled spring will cause the cord to recoil back onto the pulley. At this stage, the freewheel clutch is free and the inner race of the freewheel clutch is therefore decoupled from the outer race which will rotate with the pulley as the cord recoils onto the pulley.

Once the operator is satisfied that there is enough air in the tyre (a pressure gauge man be fitted to the apparatus), the handle can be released altogether and will retract into the housing under the action of the coiled spring. The coupling can then be detached from the Schrader or Presta valve and the process is complete.

The profile of the cam will be determined by the chosen shape of follower and by the desired operating characteristics of the apparatus. FIG. 11 shows a typical cam profile for a flat follower application. This cam is designed to achieve smooth operation at moderate pressures, with a ten degree dwell time at top dead centre (to give the air time to flow into and out of the cylinders). The table shows the data used to generate the working profile of the cam, with the rate of change of radius greatest when the piston is at the bottom of the cylinder and reduced as the piston approaches the top of the cylinder and the piston is pushing against high pressures inside the cylinder. The profile from 180 degrees to 360 degrees is not used, as the cam will act first against one of the pistons then against the other, so that the other side of the cam is never used. Part of this unused side of the cam must be removed to form a 'cut away' 224 as shown, to prevent it fouling with the piston and jamming the apparatus.

The present invention is superior to the prior art because the use of appropriately designed cams may significantly smooth the rather jerky operation of a crankshaft and connecting rod based system. Not only does this make the system smoother in operation, but it also reduces the peak forces involved, thereby reducing peak stresses and allowing the apparatus to be manufactured from smaller and lighter components. The present invention also allows larger cylinders to be used without leading to excessive jerkiness and excessive peak forces. A further advantage is that the apparatus can be smaller, as the cam can operate directly on the base of the pistons whereas a crankshaft must be separated from the piston by a connecting rod. This makes a crankshaft and connecting rod based system larger by an amount roughly equal to the length of the connecting rod. The apparatus is also cheaper to manufacture as there are fewer components than in a crankshaft and connecting rod based system since crankshafts are not required.

When used in conjunction with pull-cord pumps operating substantially according to EP 0806568, the present invention's main advantage is that it enables larger cylinders to be used without increasing peak forces. Pumps of this kind must either incorporate a gearbox means or use large cylinders, as recoil springs cannot reliably achieve more than 30–40 turns. This does not provide sufficient volume of air for a pump manufactured according to this patent to fill a bicycle tyre quickly unless a gearbox means or large cylinders are used.

When used in conjunction with clutchless pull-cord pumps (as shown in FIG. 12 and described below), large cylinders can be avoided by reducing the diameter of the rotating shaft, but the smoother operation of the present invention compared to that of a crankshaft and connecting rod embodiment helps the cord to grip the rotating shaft when required. The cyclical forces associated with a crankshaft and connecting rod embodiment can cause vibrations that affect the ability of the cord to grip the rotating shaft, reducing the efficiency of the pump and possibly leading to undue wear on the cord and other parts of the apparatus.

Other example versions of the Cam embodiment of the present invention are described below.

For a single cylinder version of the Cam embodiment of the present invention, a cam may be designed which smoothes the function of the apparatus over significantly more than 180 degrees, but cannot smooth the function over 360 degrees without the use of other smoothing elements such as a system of springs. Springs can be arranged to absorb energy during the part of the cycle in which air is not being compressed and to release that energy back into the piston during the part of the cycle in which air is being compressed. A spring or similar arrangement would also be required to push the piston onto the cam when air is being drawn into the cylinder.

For embodiments incorporating two or more cylinders, a cam profile may be designed which achieves a substantially smooth function over 360 degrees, for a given pressure.

In some embodiments, a plurality of pistons may be operated by one or more cams on the main shaft.

In clutchless versions of the Cam embodiment of the present invention, the function of the clutch may be achieved by wrapping the cord a few times around the rotating shaft, so that when the cord is pulled the cord grips the shaft and drives the shaft, but when the cord is released it slides over the surface of the shaft and is recoiled onto a pulley. An example of this is shown in FIG. 12.

FIG. 12 shows a system for tensioning the cord, comprising a fixed 'slave shaft' (not shown) mounted on 'mounting blocks' 226, with the pulley rotatably mounted on the slave shaft and the coiled spring creating a torque between the slave shaft and pulley.

The internal end of the cord is attached to the pulley. The cord is then wound a number of times around a 'main shaft'

227, (shown in the figures with one and three quarters turns) before passing out through the hole in the lid and being attached to the handle. The number of turns of the cord around the main shaft should be sufficient that the cord can impart enough torque to the main shaft to drive it when there is tension in both the 'tailing part' 203A and the 'working part' 203B of the cord, but few enough that the cord can slide around the main shaft when there is tension only in the tailing part of the cord. The number of turns required will depend on many factors including the design of the cord, the design of the main shaft and the tension in the tailing part of the cord. In certain circumstances, the number of turns required may be less than one.

Underneath the main shaft, the two turns of the cord are separated by a 'cord guide' 229 which passes close to the main shaft and prevents the cord from travelling along the main shaft.

In some versions of the Cam embodiment of the present invention, the apparatus can be designed so that the pump drives in both directions (more like U.S. Pat. No. 5,180,283) and the profile of the cam can be designed to be symmetrical so that the pump will drive equally well in either direction.

In some versions of the Cam embodiment of the present invention, other designs of follower can be used and the shape of the cam can be altered to suit the shape of the chosen follower.

The Rotary Cleat embodiment is another important example of the present invention. The text from here to the end of the main description describes the Rotary Cleat embodiment of the present invention.

The Rotary Cleat embodiment of the present invention provides an apparatus for movement or compression of a fluid comprising:

pump or compressor means arranged to receive a mechanical rotational drive input; and drive means arranged to provide said drive input;

said drive means comprising a rotary part and pull-cord means passing round said rotary part, a first end of said pull-cord means being arranged to have a first tensile force applied to it and a second end of said pull-cord means being arranged to have a second tensile force applied to it by a user, whereby application of said second force by a user causes movement of said cord means in a first direction and corresponding rotation of said rotary part, said rotation being used to provide said mechanical rotational input.

The pull-cord means may pass round said rotary part to a degree of more than one complete turn, or to a degree of one complete turn, or to a degree of less than one complete turn. The pull-cord means may comprise one of a cable, rope, cord, string, chain and belt.

In the Rotary Cleat embodiment the apparatus further comprises a take-up means separate from said rotary part arranged to apply said first force to said first end of said pull-cord means and to retract said pull-cord means in the absence of said second force. Preferably the take-up means comprises a winding means arranged to have said pull-cord means wound thereon and spring means associated with said winding means in order to apply said first force to said pull-cord means.

In an alternative embodiment the first end of said pull-cord means is arranged to have said first force applied to it by said or another user.

In the Rotary Cleat embodiment, in the absence of said second force, said first force causes movement of said cord means in a second direction opposite to said first direction and further preferably this movement causes substantially no corresponding rotation of said rotary part.

This is facilitated in the Rotary Cleat embodiment as force is transferred from said pull-cord means to said rotary part to cause said rotation by way of frictional contact.

The pull-cord means may be arranged to pass round a portion of said rotary part having a circular or polygonal cross-section. In some embodiments the cross-section of the portion of the rotary part round which the pull-cord passes is configured to partially deform said pull-cord means whereby to increase grip. In a further alternative the cross-section is not symmetrical whereby grip in one rotational direction is greater than in the other. In a further alternative the portion of the rotary part round which the pull-cord means passes comprises gripping means arranged to grip said pull-cord means when it is pulled in said first direction and to release said pull-cord means when it is pulled in said second direction. In this latter arrangement the gripping means may comprise a clam cleat.

Additionally, the rotary part may comprise portions of different cross-section with said pull-cord means being arranged to pass selectively round one of said portions. In particular one of said portions may be of larger cross section than another.

Preferably the rotary part is a rotary shaft extending from and arranged to provide said drive input to said pump or compressor means.

The Rotary Cleat embodiment of the present invention will now be described by reference to FIGS. 13 to 15.

FIG. 13 shows that the apparatus is substantially inside a 'housing' 101 contained by a 'lid' 102. A 'cord' 103 is shown coming out through a 'hole' 104 in the lid 102 and the external end of the cord 103 is attached to a 'handle' 105. The lid 102 is designed with a 'footplate' 106 to enable an operator to hold it in place on the ground with his foot, against the forces that will be applied to it as a result of tension being applied to the cord 103 by means of the handle 105.

FIGS. 14 and 15 show the rest of the apparatus, including a system for tensioning the cord 103, comprising a fixed 'slave shaft' 107 mounted on 'mounting blocks' 108, with a 'pulley' 109 rotatably mounted on the slave shaft 107 and a 'coiled spring' 110 creating a torque between the slave shaft 107 and pulley 109.

The coiled spring 110 is reverse coiled inside a 'recess' 111 and the outer end of the coiled spring 110 is attached to the inside of the recess 111 in the pulley 109. The inner end of the coiled spring 110 is attached to the slave shaft 107.

The internal end of the cord 103 is attached to the pulley 109. The cord 103 is then wound a number of times around a 'main shaft' 112, (shown in the figures with one and three quarters turns) before passing out through the hole 104 in the lid 102 and being attached to the handle 105. The number of turns of the cord 103 around the main shaft 112 should be sufficient that the cord 103 can impart enough torque to the main shaft 112 to drive it when there is tension in both the 'tailing part' 103A and the 'working part' 103B of the cord 103, but few enough that the cord 103 can slide around the main shaft 112 when there is tension only in the tailing part 103A of the cord 103. The number of turns required will depend on many factors including the design of the cord 103, the design of the main shaft 112 and the tension in the tailing part 103A of the cord 103. In certain circumstances, the number of turns required may be less than one.

Underneath the main shaft 112, the two turns of the cord 103 are separated by a 'cord guide' 113 which passes close to the main shaft 112 and prevents the cord 103 from travelling along the main shaft 112.

The main shaft 112 is rotatably mounted in 'bearings' 114, and on one end of the main shaft 112 is mounted an off-centre 'spigot' 115. A 'connecting rod' 116 is rotatably mounted both on the spigot 115 and on a 'piston bearing' 117 which is mounted on the bottom of a 'piston' 118, and the piston 118 is free to slide inside a 'cylinder' 119. A seal (not shown) forms an air-tight seal between the piston 118 and the cylinder 119.

At the top end 119A of the cylinder 119 there is an 'inlet valve' 120 arranged to draw air into the cylinder 119 from the atmosphere and an 'outlet valve' 121 arranged to deliver compressed air into a hose (not shown) from the cylinder 119. The other end of the hose is fitted with an appropriate coupling (not shown) to enable it to be attached with an airtight seal to an appropriate valve. In the context of bicycle tyres, this is likely to be a Schrader or Presta valve.

The operation of the Rotary Cleat embodiment, used to inflate a bicycle tyre will now be described with reference to FIGS. 14 and 15.

The apparatus is placed on the ground near to the tyre which is to be inflated and the coupling is attached to the tyre valve. The apparatus should be close enough to the tyre for the hose not to be unduly stressed. The operator places his/her foot on the footplate to hold the apparatus in place and then grasps the handle in his/her hand.

The operator then repeatedly pulls on the handle causing the cord to unwind from the pulley, then releases the handle and lets the coiled spring recoil the cord back on to the pulley. When the operator is pulling the handle, the cord grips the main shaft and drives the pump but when the operator releases the handle, the cord slips on the main shaft and recoils easily onto the pulley. This is described in detail in the paragraphs below.

As the operator pulls on the handle, the cord unwinds from the pulley and the pulley rotates against the torque from the coiled spring. Let us assume that the tension in the tailing part 103A is $T_{Tailing}$ and that the tension in the working part 103B is $T_{Working}$. These two opposing tensions will cause the cord to grip the main shaft, by friction or possibly other means as described below. When the operator pulls on the handle, $T_{Working}$ becomes greater than $T_{Tailing}$ and will cause the main shaft to rotate because there is sufficient grip between the cord and the main shaft.

The rotation of the main shaft will cause the spigot to rotate about the axis of the main shaft, which will in turn cause the connecting rod and piston to reciprocate inside the cylinder. As the piston moves towards the main shaft, air is drawn into the cylinder via the inlet valve, then as the piston moves back away from the main shaft, air is compressed inside the cylinder then discharged through the outlet valve into the hose and thence via the coupling and the Schrader or Presta valve into the tyre itself.

The cord is prevented from moving along the main shaft by means of the cord guide, which also prevents the cord wrapping over itself and affecting the smooth operation of the apparatus.

When the operator stops pulling the handle, the Schrader or Presta valve and the outlet valve will close. There may be some partially compressed air in the cylinder which may cause the piston to be pushed slightly back towards the main shaft. This does not affect the successful operation of the apparatus.

When the operator releases the handle, there will no longer be any tension $T_{Working}$ in the working part of the cord. The tension $T_{Tailing}$ from the coiled spring will tend to pull the cord back onto the pulley. Importantly, since there is no longer any tension $T_{Working}$, the cord will no longer grip the main shaft so the cord will now slip over the main shaft and run easily back onto the pulley without having to drive the main shaft and the pump.

Again, the cord is prevented from moving along the main shaft by means of the cord guide, which also prevents the cord wrapping over itself and affecting the smooth operation of the apparatus.

Once the operator is satisfied that there is enough air in the tyre (a pressure gauge may be fitted to the apparatus), the handle can be released altogether and will retract into the housing under the action of the coiled spring. The coupling can then be detached from the Schrader or Presta valve and the tyre inflation process is complete.

It is not necessary to dwell upon the design of the crankshaft, connecting rod, piston, cylinder, valves, hose and coupling here as this is merely one example of a pump or compressor and such pumps are well known already. Since the core of the Rotary Cleat embodiment of the present invention is the interface between the cord and the main shaft, this will now be described in greater detail.

One means by which the cord may grip the main shaft is friction. There are established engineering equations governing the limiting friction (F) between a cord and a shaft. Firstly, the limiting friction F is simply the difference between the tension at one end of the cord $T_1$ and the tension at the other end $T_2$. For $T_2$ greater than $T_1$:

$$F=T_2-T_1$$

But also:

$$T_2=T_1e^{fa}$$

where 'e' is the base of Napierian logarithms (roughly 2.718), 'f' is the coefficient of friction and 'a' is the angle of contact between the cord and the shaft (measured in radians).

Let us first consider the case where $T_2$ is $T_{Working}$, the pulling force applied by the operator and $T_1$ is $T_{Tailing}$ the tailing force applied by the coiled spring. The ratio $T_2$:$T_1$ equals the ratio $T_{Working}$:$T_{Tailing}$ which equals $e^{fa}$ and is highly sensitive to f and a due to the exponential function. In other words, for a fairly small $T_{Tailing}$ the system can be designed to accommodate a large $T_{Working}$ before slipping.

Next let us consider the case where the operator releases the handle. Now, $T_{Working}$ is zero and must be $T_1$ (since $T_2>T_1$). $T_2$ is therefore $T_{Tailing}$ and F cannot exceed $T_2$, so the cord will recoil easily.

In pure theory, since $T_2=T_1e^{fa}$ and $T_1$ is zero, $T_2$ should also be zero. However, the theory above ignor several real world factors, notably the weight, stiffness and deformability of the cord. These factors combine to mean that there is some friction between the cord and the shaft even in the absence of any $T_{Working}$.

Figure 16A:
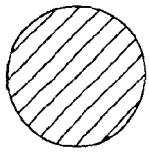
Figure 16B:
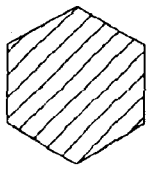
Figure 16C:
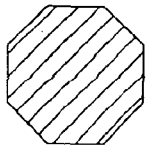

However, friction is not the only means by which the cord may grip the shaft. If the shaft is manufactured with polygonal (rather than round) cross section as shown in FIGS. 16B and 16C then another principle starts to have an effect. It has been established in the design of winches that a rope is more resistant to pulling about a polygonal cross section than about a round cross section (see U.S. Pat. No. 4,688,765 Jesus Guangorena). Guangorena says that this is caused not by friction but by the vertices of the polygons causing the rope to deform (flatten), and that there is a resistance to the propagation of this deformation along the length of the rope.

In practice, for a polished stainless steel shaft having a circular cross section, five or six turns of cord around the shaft may be required to achieve adequate grip to drive the pump—but for a polished stainless steel shaft having a hexagonal or octagonal section, two turns may be sufficient. The vertices of the polygonal section do not have to be sharp to cause the deformation in the cord, and a small radius on each vertex helps to reduce wear on the cord. Likewise, the cord will suffer less wear if there are fewer turns about the shaft and therefore fewer cord guides for it to rub against.

Figure 16D:
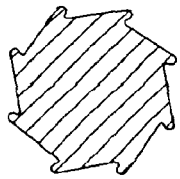

A third way in which the cord may grip the shaft is to design either the cord or the shaft or both to have an asymmetric surface, i.e. one which exerts more friction in one direction than in the other. A simple version of this is shown in FIG. 16D. Such a profile might enable the cord to grip the shaft very well in one direction despite having only a very small number of turns about the shaft (eg less than one turn), but still to slip easily in the other direction. It would also be possible to design an asymmetric cord (perhaps more like a kind of chain or a belt) having a set of teeth that enable it to grip in one direction but to slide in the opposite direction. Ultimately, such teeth might be designed to mate with asymmetric features on the profile of the shaft, effectively transforming the cord and shaft into a ratchet like system.

Figure 16E:
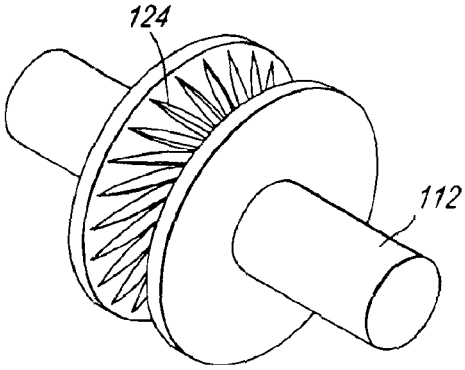
Figure 16F:
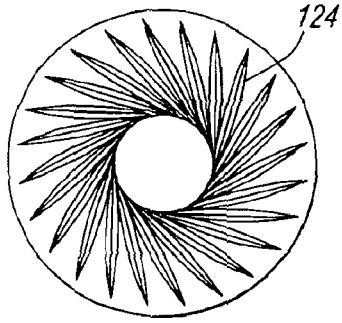

The same effect may also be achieved without using an asymmetric cord by designing the shaft to operate in the manner of a clam cleat. An example of this is shown in FIGS. 16E and 16F. The rotary clam cleat system is mounted on the main shaft so that when the user pulls the cord, the cord jams between the 'splines' 124 of the cleat system and drives the pump. The cord cannot slip around the shaft, because any increase in the working tension $T_{Working}$ will simply cause the cord to be gripped more firmly between the splines of the cleat system. However, when the user releases the handle the line of action of the tailing tension $T_{Tailing}$ will tend to pull the cord out from between the splines of the cleat system and the cord will be pulled freely under the action of $T_{Tailing}$. FIGS. 16E and 16F show straight splines, but the splines could form arcs of circles or be part of spirals or some other form. In particular, they could have an involute form (the path traced by the end of a cord being unwound off a circular shaft).

However, for conventional shafts the other parameter affecting the number of turns required is the tailing tension $T_{Tailing}$. The effect of increasing this tension (by strengthening the spring) is both to increase the friction between the cord and the shaft (so that it grips more when the handle is pulled) and to increase the recoiling tension (so that the cord recoils more easily onto the pulley). However, the spring should not be made too strong as the work that is put into the spring while pulling on the handle is not being used to drive the pump and is not recovered.

FIGS. 14 and 15 show a small number of turns (1.75 turns) for the sake of clarity. This assumes either a high friction main shaft, or a polygonal main shaft, or a strong coiled spring.

One problem that can arise in implementations of the Rotary Cleat embodiment of the present invention is that the cord can tend to travel along the main shaft, ultimately wrapping over itself and affecting the smooth operation of the apparatus. The apparatus may be designed with a shaft long enough to allow this to happen, or this may be prevented as indicated above by means of a cord guide. The use of a cord guide is not ideal, as this causes friction between the cord and the shaft as the cord is pushed axially along the shaft by the cord guides.

There are many design details that can be used singly or in combination to prevent the cord wrapping over itself and to prevent excessive friction between the shaft and the cord. Winches are often designed with an hourglass or dumbbell form or with angled ends, allowing the cord to move along the shaft between limits and preventing it wrapping over itself at the ends. A tapered shaft would work in a similar way. Alternatively, the working end and tailing end of the cord may be led away from the main shaft at angles that will prevent the wrapping over problem, either preventing or allowing a certain amount of axial movement along the shaft.

The problem can also be prevented if the cord can drive the shaft with a number of turns that is less than one, as then it may operate in a groove in the shaft without having any tendency to propagate along the shaft. This may be easier to achieve using a belt rather than a cord, so that the surface area in contact with the shaft may be large even though the number of turns used is less than one.

A similar effect using a larger number of turns may be achieved by mounting two shafts parallel to each other, as shown in FIG. 17, either one or both of which may be driven by the cord. In the case shown, the main shaft 112 is driven by the cord and a 'free shaft' 122 is simply free to rotate in bearings (not shown). The cord 103 operates in a series of 'grooves' 123 in both shafts. The effective number of turns is therefore quite large, but the cord has no tendency to move axially along either shaft and there is no rubbing between the cord and the shaft.

There are two main reasons why the Rotary Cleat embodiment of the present invention is superior to EP 0806568. Firstly, the Rotary Cleat embodiment of the present invention requires no freewheel or overrunning clutch, which is an expensive component. The freewheel or overrunning clutch is also potentially an unreliable component, as bicycle pumps may be subjected to dirt and damp which could affect the reliable operation of such a component. Secondly, the use of a main shaft and a slave shaft enables the number of rotations of the pulley to be different from the number of rotations of the pump, without the use of any additional transmission system such as a system of gears. This is important, because coiled springs cannot generally provide much more than about 30–40 turns, which limits the number of turns of cord on the pulley to the same number. In order to supply a sufficient quantity of air, this requires the use of larger cylinders than might otherwise be chosen, or the use of multiple cylinders, all of which adds cost. The same effect can be achieved with the Rotary Cleat embodiment of the present invention simply by reducing the diameter of the main shaft.

Other versions of the Rotary Cleat embodiment of the present invention are described below.

Firstly, the tailing tension $T_{Tailing}$ could be supplied by means other than those described above. A simple change would be to make the slave shaft rotate with the pulley and the spring act between the shaft and the housing. More fundamentally, $T_{Tailing}$ could come from other sources entirely, such as a weight being suspended from the tailing end of the cord. Alternatively, the tailing end of the cord could be led back out of the housing to another handle, and the user could provide the tailing force themselves with their other hand. There are, of course, many other possibilities too.

In the multi-cylinder version of the Rotary Cleat embodiment, a plurality of pistons may be operated by a plurality of connecting rods being driven by a crankshaft attached to the main shaft.

In the spring assisted version of the Rotary Cleat embodiment, one or more springs may be used to help to smooth out variations in the torque at the pulley that occurs naturally each cycle. This variation is most pronounced in the single-cylinder reciprocating piston version of the Rotary Cleat embodiment (without cams), in which no work is done during at least half the cycle as the piston is drawing air into the cylinder. A system of springs may be devised in which the springs will absorb energy during the parts of the cycle in which less work is done on the air, and be allowed to relax (releasing some of their stored energy) during the parts of the cycle in which more work is done on the air.

There are also several multi-speed versions of the Rotary Cleat embodiment. In the first multi-speed embodiment, the main shaft would have a smaller cross section and a larger cross section, separated axially along the main shaft, such that the main shaft could be driven either by the cord gripping the smaller cross section or by the cord gripping the larger cross section. The cord guide could be movable both axially along the main shaft and radially (towards the axis of the main shaft when the smaller cross section is in use). Alternatively, the main shaft could be movable axially and the cord guide could be movable radially.

In the second multi-speed embodiment, there is a sleeve around part of the main shaft which has a larger cross section than the main shaft itself. With the tension in the cord slackened off, the sleeve can be moved along the main shaft, then the cord will grip the surface of the sleeve rather than the surface of the shaft.

What is claimed is:

1. Apparatus for movement or compression of a fluid, comprising:

pump or compressor means arranged to receive a mechanical rotational drive input by way of a rotary shaft; and drive means arranged to provide said drive input;

said drive means comprising:

a rotary part and pull-cord means passing around said rotary part such that said rotary part rotates when an end of said pull-cord means is pulled by a user, the rotation of the rotary part being used to provide said mechanical rotational drive input; and torque providing means arranged to provide a torque acting to retract said pull-cord means;

wherein said rotary part and said torque providing means are not both co-axial and co-planar and wherein said torque providing means is arranged co-axially with said rotary part and axially displaced with respect to said rotary part.

2. Apparatus according to claim 1 in which said rotary part comprises a pulley around which said pull-cord means is wound and which rotates when said end of said pull-cord means is pulled, and said drive means further comprises transmission means arranged to transmit rotation of said pulley to said rotary shaft.

3. Apparatus according to claim 2 in which said transmission means comprises one of a freewheel, clutch and ratchet means arranged such that rotation of said pulley during retraction is not transmitted to said rotary shaft.

4. Apparatus according to claim 3 in which said pulley and said one of freewheel, clutch and ratchet means are mounted co-axially to said rotary shaft.

5. Apparatus according to claim 1 in which movement of said pull-cord means during retraction does not cause rotation of said rotary shaft.

6. Apparatus according to claim 1 in which said torque providing means comprises one of a coil spring, torsion bar and elastic band.

7. Apparatus according to claim 1 in which said pump or compressor means comprises a piston, and in which said rotational drive input is arranged to drive a crank means carrying an eccentrically mounted spigot acting as a cam on a pair of followers provided as internal faces of said piston.

8. Apparatus according to claim 7 in which said piston is a double-ended piston.

9. Apparatus according to claim 7 in which said internal faces are parallel.

10. Apparatus for movement or compression of a fluid, comprising:

pump or compressor means arranged to receive a mechanical rotational drive input by way of a rotary shaft; and drive means arranged to provide said drive input;

said drive means comprising:

a rotary part and pull-cord means passing around said rotary part such that said rotary part rotates when an end of said pull-cord means is pulled by a user, the rotation of the rotary part being used to provide said mechanical rotational drive input; and torque providing means arranged to provide a torque acting to retract said pull-cord means;

wherein said rotary part and said torque providing means are not both co-axial and co-planar and wherein said torque providing means is displaced from the rotational axis of said rotary part and the apparatus comprises torque transmission means via which said torque provided by said torque providing means is applied to said rotary part.

11. Apparatus according to claim 10 in which said torque transmission means comprises gear means.

12. Apparatus according to claim 10 in which said torque transmission means comprises a sprocket and timing belt or chain means.

13. Apparatus according to claim 10 in which said rotary part comprises a pulley around which said pull-cord means is wound and which rotates when said end of said pull-cord means is pulled, and said drive means further comprises transmission means arranged to transmit rotation of said pulley to said rotary shaft.

14. Apparatus according to claim 13 in which said transmission means comprises one of a freewheel, clutch and ratchet means arranged such that rotation of said pulley during retraction is not transmitted to said rotary shaft.

15. Apparatus according to claim 14 in which said pulley and said one of freewheel, clutch and ratchet means are mounted co-axially to said rotary shaft.

16. Apparatus according to claim 10 in which movement of said pull-cord means during retraction does not cause rotation of said rotary shaft.

17. Apparatus according to claim 10 wherein said torque providing means comprises one of a coil spring, torsion bar and elastic band.

18. Apparatus for movement or compression of a fluid, comprising:

pump or compressor means arranged to receive a mechanical rotational drive input by way of a rotary shaft; and drive means arranged to provide said drive input;

said drive means comprising:

a rotary part and pull-cord means passing around said rotary part such that said rotary part rotates when an end of said pull-cord means is pulled by a user, the rotation of the rotary part being used to provide said mechanical rotational drive input; and torque providing means arranged to provide a torque acting to retract said pull-cord means;

wherein said rotary part and said torque providing means are not both co-axial and co-planar and wherein said rotary part comprises a pulley around which said pull-cord means is wound and which rotates when said end of said pull-cord means is pulled, and said drive means further comprises transmission means arranged to transmit rotation of said pulley to said rotary shaft, and wherein said torque providing means comprises spring means coiled around a second shaft not co-axial with the rotational axis of said pulley, and further comprising a first gear mounted to said pulley and a second gear mounted to said second shaft, by way of which gears rotation of said pulley is linked to rotation of said second shaft.

19. Apparatus according to claim 18 in which said first gear directly engages said second gear.

20. Apparatus according to claim 18 further comprising one or more further gears arranged between said first and second gears.

* * * * *

UNITED STATES PATENT AND TRADEMARK OFFICE

CERTIFICATE OF CORRECTION

PATENT NO. : 6,925,927 B2
DATED : August 9, 2005
INVENTOR(S) : Peck

It is certified that error appears in the above-identified patent and that said Letters Patent is hereby corrected as shown below:

Column 9,
Line 49, delete "FIGS. 3 and 4" and replace with -- FIGS. 3 and 4. --.

Column 10,
Line 29, delete "crankshafts arrangement" and replace with -- crankshaft arrangement --.

Column 12,
Line 25, delete "is apply" and replace with -- is to apply --.
Line 43, delete "the cord 203 the inner race 213" and replace with -- the cord 203, the inner race 213 --.
Line 54, delete "between tie" and replace with -- between the --.

Column 13,
Line 17, delete "direction the" and replace with -- direction, the --.

Column 15,
Line 15, delete "'cord guide' 229" and replace with -- 'cord guide' 228 --.
Line 24, delete "designs of follower" and replace with -- designs of the follower --.

Column 18,
Line 46, delete "ignor" and replace with -- ignores --.

Signed and Sealed this

Eleventh Day of April, 2006

JON W. DUDAS
*Director of the United States Patent and Trademark Office*